US007719198B2

(12) United States Patent
Takikawa et al.

(10) Patent No.: US 7,719,198 B2
(45) Date of Patent: May 18, 2010

(54) POWER SUPPLY CIRCUIT FOR PLASMA GENERATION, PLASMA GENERATING APPARATUS, PLASMA PROCESSING APPARATUS AND PLASMA PROCESSED OBJECT

(75) Inventors: Hirofumi Takikawa, 1-3 (1-104), Aza Uehara, Ogasakicho ome, Toyohashi-city, Aichi (JP) 441-8066; Yoshimi Nishimura, Kyoto (JP); Akio Harada, Osaka (JP)

(73) Assignees: Hirofumi Takikawa, Aichi (JP); Daiken Chemical Co., Ltd., Osaka (JP)

( * ) Notice: Subject to any disclaimer, the term of this patent is extended or adjusted under 35 U.S.C. 154(b) by 850 days.

(21) Appl. No.: 10/594,980

(22) PCT Filed: Feb. 17, 2005

(86) PCT No.: PCT/JP2005/002479

§ 371 (c)(1),
(2), (4) Date: Sep. 29, 2006

(87) PCT Pub. No.: WO2005/101927

PCT Pub. Date: Oct. 27, 2005

(65) Prior Publication Data

US 2007/0176562 A1 Aug. 2, 2007

(30) Foreign Application Priority Data

Mar. 31, 2004 (JP) ..... 2004-102452

(51) Int. Cl.
*H01J 7/24* (2006.01)

(52) U.S. Cl. ..... 315/111.21; 313/231.31; 204/298.08

(58) Field of Classification Search ..... 315/111.21, 315/111.31, 111.81, 111.91; 361/234, 235; 313/231.01, 231.31; 422/186.04, 186.05, 422/186.21, 186.26, 186.29, 906; 204/298.08, 204/298.06, 298.02; 156/345.45, 345.44, 156/345.43

See application file for complete search history.

(56) References Cited

U.S. PATENT DOCUMENTS 4,887,005 A * 12/1989 Rough et al. ..... 422/906
5,807,470 A * 9/1998 Szczyrbowski et al. 204/298.08

(Continued)

FOREIGN PATENT DOCUMENTS

JP 60-262972 12/1985

(Continued)

*Primary Examiner*—Douglas W Owens
*Assistant Examiner*—Ephrem Alemu
(74) *Attorney, Agent, or Firm*—William L. Androlia; H. Henry Koda

(57) ABSTRACT

A power supply circuit for plasma generation by which a large quantity of generated plasma can be smoothly obtained without increasing the sizes of an apparatus. An electric discharge generating electrode is composed of two or more first electrodes and one or more second electrodes. An LC series circuit is provided by connecting a capacitor C and a coil L in series between one of outputs of an alternating high voltage generating circuit which generates an alternating high voltage to be applied between the electrodes of electric discharge generating electrode, and the first electrode. When electricity is discharged in one of the electrode pair, voltage drop is suppressed by the coil, and since electric discharge from the other electrode pair is induced without being disturbed, a large quantity of plasma can be smoothly generated by common use of the alternating high voltage generating circuit.

19 Claims, 18 Drawing Sheets

U.S. PATENT DOCUMENTS

| | | | | |
|---|---|---|---|---|
| 6,183,605 | B1 * | 2/2001 | Schatz et al. | 204/298.08 |
| 6,367,413 | B1 * | 4/2002 | Sill et al. | 118/723 E |
| 6,396,213 | B1 * | 5/2002 | Koloc | 315/111.21 |
| 2004/0131513 | A1 * | 7/2004 | Lazarovich et al. | 422/186.04 |

FOREIGN PATENT DOCUMENTS

| | | |
|---|---|---|
| JP | 5-59198 | 3/1993 |
| JP | 2001-35693 | 2/2001 |
| JP | 2001-297898 | 10/2001 |
| WO | WO 02/39791 | 5/2002 |

* cited by examiner

POWER SUPPLY CIRCUIT FOR PLASMA GENERATION, PLASMA GENERATING APPARATUS, PLASMA PROCESSING APPARATUS AND PLASMA PROCESSED OBJECT

TECHNICAL FIELD

The present invention relates to a power supply circuit for plasma generation applying an alternating high voltage between electrodes, a plasma generating apparatus generating a plasma by discharge based on said power supply circuit, a plasma processing apparatus producing an object substance from an object to be processed and performing surface treatment, sterilization, disinfection, washing, reforming, wettability improvement, and cutting etc. of said object to be processed, and their produced objects.

BACKGROUND ART

In this kind of plasma generating apparatus due to electric discharge, the commercial frequency voltage or the high frequency voltage is raised up with high frequency transformer, so that the plasma is generated by applying its raised voltage between the opposed electrodes.

For example, in a plasma surface processing apparatus shown in Japanese Patent Laid-Open No. 2001-297898 of the following Patent Document 1, the plasma generating apparatus is disclosed in FIG. 18. This plasma generating apparatus consists of a power supply circuit 100, a high frequency transformer 103, and a pair of electrodes 104, 105. Said power supply circuit 100 applies the high frequency voltage to the primary coil 101 of said high frequency transformer 103. At the secondary coil 102 of high frequency transformer 103, the raised high frequency voltage of about several thousand to ten thousand V occurs, and this high frequency voltage is applied between a pair of electrodes 104, 105. As a result, a plasma is generated by an electric discharge occurred between said pair of electrodes 104, 105. An air pump P generates an air flow by receiving the power supply from said power supply circuit 100. This air flow is supplied between a pair of electrodes 104, 105 and the plasma generated between electrodes is blown on the surface of object to be processed 106. By means of this plasma irradiation, the surface treatment of object to be processed 106 is performed. In addition, the condensers 107, 110 for limiting the discharge current are interposed between said secondary coil 102 and each electrode 104, 105. The resistance 109 connected in parallel to condensers 107, 110 is disposed to make the charged voltage remaining in condensers 107, 110 discharge immediately after stop of discharge and to prevent electric shocks due to its remaining electric charge.

Said plasma generating apparatus is applied to a plasma surface treatment device of object to be processed. However, since the possible range of plasma treatment is restricted essentially in the surface treatment device by single electrode pair, a plurality of plasma surface treatment devices are required to perform the treatment more in depth and more effectively. However, a method that a plurality of plasma surface treatment devices are employed increases in cost and a problem that the scale of treatment device becomes larger occurs. As one of countermeasure of this problem, there are methods that the power supplying circuit portion such as power supply circuit and high frequency transformer in the plasma generating apparatus is used in common, and the electric power is supplied to plural pairs of electrode, so that it is considered that the device generating the wider and larger plasma can be developed with small size and low cost.

FIG. 17 shows a common use example of power supplying circuit portion. The same reference numerals are used for the same components as FIG. 18. The common electrode 112 is disposed at the ground side of secondary coil 102, and two electrodes 111, 113 are arranged opposed to said common electrode. The condensers 114, 115 are interposed between each electrode and said secondary coil 102. According to such constitution, the power supply circuit 100 and the high frequency transformer 103 can be used in common for two pairs of electrode, but there were the following problems concerning the real plasma generation.

For example, when the electric discharge occurs between electrode 111 and common electrode 112, the electric discharge of condenser 114 advances with it. By this electric discharge, the electrical potential A of one output end of the secondary coil 102 to which condenser 114 was connected falls to several tens to 10 V, so that voltage drop occurs. As a result of this voltage drop, since the charged electricity of condenser 115 at side of another one electrode 113 flows to the electrode 111 and is lost, there was a problem that the electric discharge between electrode 111 and common electrode 112 is not induced.

[Patent Document 1] Japanese Patent Laid-Open No. 2001-297898

DISCLOSURE OF THE INVENTION

<Problems to be Solved by the Invention>

In view of the problems described above, one purpose of the present invention is to provide a power supply circuit for plasma generation and a plasma generating apparatus which can obtain a large quantity of generated plasma smoothly without jumboizing the apparatus. In addition, another purpose of the present invention is to provide a plasma processing apparatus which can treat a large quantity of object to be processed due to plasma with low cost by using of said plasma generating apparatus. Further purpose of the present invention is to provide a desired object such as powder and layered object through treating of object to be processed by using of said plasma processing apparatus.

<Means to Solve the Problems>

The present invention is proposed to solve said problems, and the first form of the present invention is a power supply circuit for plasma generation by which said plasma is generated due to discharge occurred between discharge generating electrodes composed of first and second electrodes by applying an alternating high voltage to said discharge generating electrodes, and said power supply circuit for plasma generation comprises: said discharge generating electrodes composed of two or more first electrodes and one or more second electrodes; and an alternating high voltage generating circuit to generate said alternating high voltage applied between said first and second electrodes of said discharge generating electrodes; wherein a condenser (a capacitor) and a coil (an inductor) are connected in series between said first electrode and one output end of said alternating high voltage generating circuit.

The second form of the present invention is the power supply circuit for plasma generation according to said first form, wherein said alternating high voltage generating circuit includes a high frequency transformer, two or more output circuits brunched in parallel from one end side of a secondary side coil of said high frequency transformer are connected to said first electrodes, each of said output circuits is formed by a series connection of said condenser and said coil, and said second electrode is connected to another end side of said secondary side coil.

The third form of the present invention is the power supply circuit for plasma generation according to said first form, wherein said alternating high voltage generating circuit includes a high frequency transformer, a plurality of secondary side coils are arranged at a secondary side of said high frequency transformer, one or more output circuits brunched in parallel from one end side of each secondary side coil are connected to said first electrodes, each of said output circuits is formed by a series connection of said condenser and said coil, and said second electrode is connected to another end side of said secondary side coil.

The fourth form of the present invention is a plasma generating apparatus by which said plasma is generated due to discharge occurred between discharge generating electrodes composed of first and second electrodes by applying an alternating high voltage to said discharge generating electrodes, and said plasma generating apparatus comprises: said discharge generating electrodes composed of two or more first electrodes and one or more second electrodes; and an alternating high voltage generating circuit to generate said alternating high voltage applied between said first and second electrodes of said discharge generating electrodes; wherein a condenser (a capacitor) and a coil (an inductor) are connected in series between said first electrode and one output end of said alternating high voltage generating circuit.

The fifth form of the present invention is the plasma generating apparatus according to said fourth form, wherein said alternating high voltage generating circuit includes a high frequency transformer, two or more output circuits brunched in parallel from one end side of a secondary side coil of said high frequency transformer are connected to said first electrodes, each of said output circuits is formed by a series connection of said condenser and said coil, and said second electrode is connected to another end side of said secondary side coil.

The sixth form of the present invention is the plasma generating apparatus according to said fourth form, wherein said alternating high voltage generating circuit includes a high frequency transformer, a plurality of secondary side coils are arranged at a secondary side of said high frequency transformer, one or more output circuits brunched in parallel from one end side of each secondary side coil are connected to said first electrodes, each of said output circuits is formed by a series connection of said condenser and said coil, and said second electrode is connected to another end side of said secondary side coil.

The seventh form of the present invention is the plasma generating apparatus according to said fourth, fifth or sixth form, wherein either one electrode of said first electrode or said second electrode has a geometry surrounding the other electrode, and a tip end portion of said one electrode is formed into a nozzle shape for emitting said plasma generated between said electrodes.

The eighth form of the present invention is the plasma generating apparatus according to said fourth, fifth or sixth form, wherein said first electrode and said second electrode are facing, so that said plasma generated between said electrodes is emitted from an open end side of said electrodes.

The ninth form of the present invention is the plasma generating apparatus according to any of said fourth to eighth forms, wherein said plasma generating apparatus further includes a fluid supplying means to supply a fluid into a generation area of said plasma generated between said electrodes.

The tenth form of the present invention is the plasma generating apparatus according to any of said fourth to ninth forms, wherein each of said electrode pairs is arranged in a predetermined direction.

The eleventh form of the present invention is a plasma processing apparatus including the plasma generating apparatus according to any of said fourth to tenth forms, wherein an object to be processed is irradiated with said plasma generated between said electrodes.

The twelfth form of the present invention is a plasma processing apparatus including said plasma generating apparatus according to any of said fourth to tenth forms, wherein said plasma processing apparatus is a device irradiating an object to be processed with said plasma generated between said electrodes, and each of said electrodes is arranged so that emitting directions of said plasma generated between said electrodes are facing each other.

The 13th form of the present invention is a plasma processing apparatus including said plasma generating apparatus according to any of said fourth to tenth forms, wherein said plasma processing apparatus is a device irradiating an object to be processed with said plasma generated between said electrodes, and each of said electrodes is arranged so that emitting positions of said plasma generated between said electrodes are formed in a spiral.

The 14th form of the present invention is a plasma processing apparatus including said plasma generating apparatus according to any of said fourth to tenth forms, wherein said plasma processing apparatus is a device irradiating an object to be processed with said plasma generated between said electrodes, and an aggregate of said electrodes is formed in a bundle by assembling emitting portions of said plasma generated between said electrodes.

The 15th form of the present invention is a plasma processing apparatus including the plasma generating apparatus according to any of said fourth to tenth forms, wherein said plasma processing apparatus is a device irradiating an object to be processed with said plasma generated between said electrodes, and said plasma processing apparatus further includes an adjusting means for adjusting an irradiating distance to said object to be processed irradiated with said plasma emitted from between said electrodes.

The 16th form of the present invention is a plasma processing apparatus including the plasma generating apparatus according to any of said fourth to tenth forms, wherein said plasma processing apparatus is a device irradiating an object to be processed with said plasma generated between said electrodes, and said plasma processing apparatus further includes an adjusting means for adjusting a direction irradiating said object to be processed with said plasma emitted from each space between said electrodes.

The 17th form of the present invention is the plasma processing apparatus according to any of said eleventh to 14th forms, wherein said plasma processing apparatus further includes a passageway of object to be processed distributing said object to be processed in vicinity of each of said electrodes.

The 18th form of the present invention is the plasma processing apparatus according to said 14th form, wherein said plasma processing apparatus further includes a passageway of object to be processed distributing said object to be processed to the center of said aggregate of said electrodes.

The 19th form of the present invention is a plasma processed object produced by use of the plasma processing apparatus according to any of said eleventh to 18th forms, wherein said plasma processed object is produced by plasma processing of said object to be processed.

<Effects of the Invention>

According to the first form of the present invention, since the LC series circuit in which the condenser of capacitance C and the coil of inductance L are connected in series is arranged between one output of said alternating high voltage generating circuit and said first electrode, the voltage drop of second side output of high frequency transformer is suppressed by means of said coil even when the electric discharge occurred in electrode pair of either one and its electric discharge advanced in said electrode pair. As the voltage applied to other discharge generating electrode is maintained by the suppressive operation of voltage drop due to said LC series circuit, plural electric discharges occur certainly and simultaneously. Therefore, in the power supply circuit for plasma generation of this form, since the alternating high voltage generating circuit is used in common for said plural pairs of discharge generating electrode, it can make plural pairs of electrode discharge simultaneously without making jumboize an apparatus and as a result, a large quantity of generated plasma can be obtained smoothly. In addition, low price of the plasma generating apparatus mounting the plural pairs of electrode can be realized by means of common use of the alternating high voltage generating circuit against said plural pairs of discharge generating electrode.

The alternating high voltage of the present invention includes the continuous alternating voltage, the intermittent alternating voltage, and even the pulse-shaped voltage. This pulse-shaped voltage may be both polarity, positive polarity or negative polarity. In addition, the pulse-shaped voltage may be continuous repetitive pulse, or permittent repetitive pulse. Furthermore, in the case of both polarity, the wave height values of positive wave and negative wave do not need to be same. The alternating high voltage may be also the superposed wave of direct current voltage component with alternating current voltage or pulse-shaped voltage. In other words, the alternating high voltage may be also the voltage in which high voltage and low voltage or ground voltage repeat, or the voltage in which high voltage and its reverse polarity high voltage repeat. In the case of voltage which oscillates in positive and negative, it does not interfere that wave height values of positive and negative are different.

According to the second form of the present invention, there is provided the power supply circuit for plasma generation, wherein said alternating high voltage generating circuit includes a high frequency transformer, two or more output circuits brunched in parallel from one end side of a secondary side coil of said high frequency transformer are connected to said first electrodes, each of said output circuits is formed by a series connection of said condenser and said coil, and said second electrode is connected to another end side of said secondary side coil. Since two or more output circuits for electric discharge can be connected to one secondary side coil, the generation of a large quantity of plasma can be controlled by one secondary side coil, so that circuit constitution becomes easy and circuit cost can be reduced. In addition, the high frequency transformer of the present invention may be also called the pulse transformer.

According to the third form of the present invention, there is provided the power supply circuit for plasma generation, wherein said alternating high voltage generating circuit includes a high frequency transformer, a plurality of secondary side coils are arranged at a secondary side of said high frequency transformer, one or more output circuits brunched in parallel from one end side of each secondary side coil are connected to said first electrodes, each of said output circuits is formed by a series connection of said condenser and said coil, and said second electrode is connected to another end side of said secondary side coil. Since a plurality of secondary side coils are disposed, the number of output circuit for electric discharge can be increased and decreased freely, and it gets possible to set the number of discharge electrode at a desired number. Therefore, by only increasing the number of second side coil by means of one high frequency transformer, it gets possible to perform the electric discharge with a large scale, and gets easy to generate a large quantity of plasma.

According to the fourth form of the present invention, the coil plays the voltage maintenance operation same as the first form, and it gets possible to make plural discharge electrodes discharge simultaneously. Since condenser is only connected in series to coil, the cost does not become higher even if the number of discharge increases, and it is advantageous in that plasma generating apparatus can be composed with low cost. In addition, because plural discharge electrode can be disposed in an arbitrary form, the generated plasma shape can be adjusted freely.

According to the fifth form of the present invention, since two or more output circuits for electric discharge can be connected to one secondary side coil in the secondary side of one high frequency transformer same as the second form, the number of discharge electrode can be adjusted freely by only one secondary side coil, and it is advantageous in that plasma can be generated with simple and cheap circuit constitution.

According to the sixth form of the present invention, since plural secondary side coils are arranged in the secondary side of one high frequency transformer, the number of the output circuit for electric discharge can be increased and decreased freely, and it gets possible to set the number of discharge electrode at a desired number. Therefore, by only increasing the number of secondary side coil by means of one high frequency transformer, it gets possible to perform the electric discharge with a large scale, and gets easy to generate a large quantity of plasma.

According to the seventh form of the present invention, there is provided the plasma generating apparatus, wherein either one electrode of said first electrode or said second electrode has a geometry surrounding the other electrode, and a tip end portion of said one electrode is formed into a nozzle shape for emitting said plasma generated between said electrodes. For example, when a plurality of plasma output portions of coaxial cylinder type are arranged, it becomes possible to irradiate a large quantity of plasma jet. By common use of said alternating high voltage generating circuit, such a composed plasma generating apparatus can be realized cheaply without jumboizing of apparatus.

According to the eighth form of the present invention, as the first electrode and second electrode face each other and the plasma generated between said electrodes is output from the open end side, a large quantity of plasma can be generated in a arbitrary form. For example, if each of electrode pair is disposed on a plane, the planar plasma can be emitted, or if each of electrode pair is disposed three-dimensionally, the solid-shaped plasma can be output in large quantities. By common use of said alternating high voltage generating circuit, such a composed plasma generating apparatus can be realized cheaply without jumboizing of apparatus.

According to the ninth form of the present invention, since the fluid supplying means is disposed to supply a fluid in generation area of the plasma occurred between the electrodes, the plasma is blown on the object to be processed and the generated plasma can be utilized efficiently when a gas flow such as air is generated and flowed to said generation area of plasma by said fluid supplying means. In this case, since the flowed gas can be changed to plasma, the plasma of an arbitrary gas can be irradiated for object to be processed. Said fluid may be a liquid such as water. When the electrodes are dipped in the liquid, it becomes possible to change an arbitrary liquid to plasma by supplying the liquid between the electrodes. As said supplying means, gas blower etc. can be used in gas, and pump, screw, propeller etc. can be used in liquid. In addition, when powder or liquid as the object to be processed is mixed in the fluid, said object to be processed can be transported and supplied in said plasma generation area.

According to the tenth form of the present invention, as each of said electrode pair is arranged in the predetermined direction, for example plural output portions outputting the plasma in a planar shape or three-dimensionally can be disposed, so that it becomes possible to realize the composite plasma generating apparatus which can irradiate the plasma in a planar shape or three-dimensionally. When the large planar second electrode is disposed and a plurality of small planar first electrodes are arranged to face said second electrode, the gap-shaped large plasma can be formed in their gaps. In this case, dielectric can be arranged at the opposed aspect side of electrodes. In addition, when a container is assumed to be the second electrode and plural rod-shaped first electrodes are coaxially disposed in this container, the plasma which spread through the whole container can be generated.

According to the eleventh form of the present invention, since the plasma processing apparatus which emits the plasma generated by each of said electrode pair to object to be processed is provided, a large quantity of plasma emitted simultaneously from plural electrode pairs can be irradiated to said object to be processed, and it gets possible to plasma-process efficiently depending on form or quantity of said object to be processed. In this process, there are contained a wide range of processes such as surface treatment, sterilization, disinfection, washing, reforming, wettability improvement, cutting and production of purpose substance from object to be processed.

According to the twelfth form of the present invention, the plasma processing apparatus includes said plasma generating apparatus according to any of said fourth to tenth forms, and the emitting directions of said plasma generated between said electrodes are facing each other. When the object to be processed was introduced into a plasma processing region formed from plasma generated by each electrode pair, a large quantity of generated plasma is irradiated once, and it gets possible to improve the processing ability. For example, when plural electrode pairs are arranged radially and the plasma is irradiated to the central region, the plasma density of said central region increases rapidly. Next, when the raw material gas being the object to be processed is introduced into said plasma, the purpose powder can be produced efficiently. In addition, if the object to be processed of arbitrary shape is passed in this central region, the plasma can process the circumferential surface of object to be processed simultaneously, so that it is carried out effectively the treatment such as layering and reforming of surface.

According to the thirteenth form of the present invention, since each of said electrode pairs is disposed so as that the output positions of plasma generated by each of said electrode pairs are displaced in a spiral, it can be realized the plasma processing apparatus in which the plasma processing region composed of generated plasma due to each of said electrode pairs is spread three-dimensionally. This spiral state includes the case that plasma emitted by each electrode pair is excentric from center point, so that plasma stream circles in the plasma processing region, and in this case the object to be processed such as raw material gas gets possible to be processed uniformly. Additionally, if the plasma is emitted angularly upwardly in the excentric state, said plasma circling flow rises spirally, so that large capacity of said plasma processing region can be realized and a large quantity of processing for the object to be processed is enabled.

According to the 14th form of the present invention, since the aggregate of each electrode pair in which the output portions of plasma generated by each electrode pair gather in the shape of bundle is formed, it can be realized the plasma processing apparatus by which said aggregate can output a large quantity of plasma in a bundle. Namely, when the electrode pair is composed in the shape of cylindrical electrode, the plasma jet emitted by each electrode pair becomes a bundle so that large plasma jet flow is emitted. If the object to be processed is processed by this large area plasma jet flow, the plasma process can be effectively performed according to the shape and quantity of the object to be processed. In the case of that the electrode pair is not the shape of cylindrical electrode, when the electrode pairs are accumulated or disposed radially and plural groups of said electrode pairs are bundled, the large capacity plasma stream can be formed so that the efficient processing of object to be processed can be realized by said large capacity plasma stream.

According to the 15th form of the present invention, since the adjusting means for adjusting the irradiating distance to said object to be processed irradiated with said plasma emitted from between said electrodes is arranged, the processing efficiency for object to be processed can be adjusted freely by adjusting the irradiating distance. When the object to be processed is raw material gas, the production efficiency of object can be adjusted ideally by adjusting the plasma irradiation efficiency for the raw material gas. In addition, when the object to be processed is solid material, it gets possible to increase the efficiency to layer by adjusting the surface treatment of solid material.

According to the 16th form of the present invention, the irradiation direction to the object to be processed of plasma emitted from electrode pair can be controlled and adjusted freely. For example, when the electrodes are radially arranged in the cylindrical reaction portion, by changing the irradiation direction of plasma freely, the reaction efficiency to generate the object powder can be adjusted ideally for the raw material gas fed to said cylindrical reaction portion. In addition, when the object to be processed is solid object, the processing state of said solid object surface can be changeably adjusted and the optimum design can be realized according to the purpose of plasma process.

According to the 17th form of the present invention, since the passageway of object to be processed feeding the objects to be processed is disposed in the vicinity of each electrode pair, the object to be processed such as fuel gas, catalyst and powder is brought to contact with the generated plasma through said passageway of object to be processed, and the generation efficiency of object can be adjusted. Said passageway of object to be processed can feed not only fluid such as gas and liquid but also solid object. Therefore, even if the object to be processed comprises any kind of form such as gas, liquid and solid, by means of designing the passageway of object to be processed appropriately, it gets possible to realize the plasma processing suitably.

According to the 18th form of the present invention, in said 13th form, since the passageway of object to be processed feeding said object to be processed is disposed in the central portion of the aggregate of each electrode pair, the object to be processed can be fed into a large quantity of plasma generated in a bundle by said aggregate, and the processing efficiency can be improved through effectively contacting with the generated plasma.

The plasma processing apparatus of said 11th to 18th form can be applied to the process such as shape transformation, pelletization, chamfering, surface roughening and projection removal of solid material like toner, glass, ceramics, metal, semiconductor, plastic, rubber and elastomer.

According to the 19th form of the present invention, by using the plasma processing material of any of said 7th to 14th forms, the predetermined plasma processed object can be produced through plasma processing of said object to be processed. By way of example only, through plasma processing, it can be produced the plasma processed object given the surface processing such as surface reforming, wettability improvement, cleaning, etching, resist stripping, painting, printing, print preprocessing, coating, evaporation, application, layer preprocessing, seal, sealing, joining, adhesion preprocessing, oxidization-resisting reinforcement, and reduction-resisting reinforcement. Moreover, it can be provided the object of solid with the surface membrane such as metal membrane, electroconductive • insulative • semiconductive ceramics membrane (oxide membrane, nitride membrane, carbide membrane etc: for example, aluminium oxide membrane, silicon oxide membrane, zinc oxide membrane, ITO (indium tin oxide membrane), ATO (antimony tin oxide membrane), dielectric membrane (barium titanate etc.), piezoelectric substance (PZT, AlN, ZnO etc.), magnetic substance membrane), superconductor membrane, diamondlike carbon membrane (called DLC, amorphous carbon membrane, or diamond-like carbon membrane), polymer • resin • plastic membrane, and fluoride membrane. In addition, it can be provided the object performed processing such as effluent gas processing of NOx or SOx, sterilization, pasteurization, washing, deodorization, waste oil disposal, polluted thing disposal of dioxin, and ozone disposal. Furthermore, it can be produced the carbon system nanopartide synthesized by plasma processing as object such as carbon nanotube, carbon nanocoil, carbon nanotwist, carbon nanohorn, and fullerene, and can be also produced the functional particle as object such as titanium oxide, barium titanate, lithium manganate, lithium cobalt oxide, lithium nickel oxide, zinc oxide and silicon oxide.

DENOTATION OF REFERENCE NUMERALS

Figure 1:
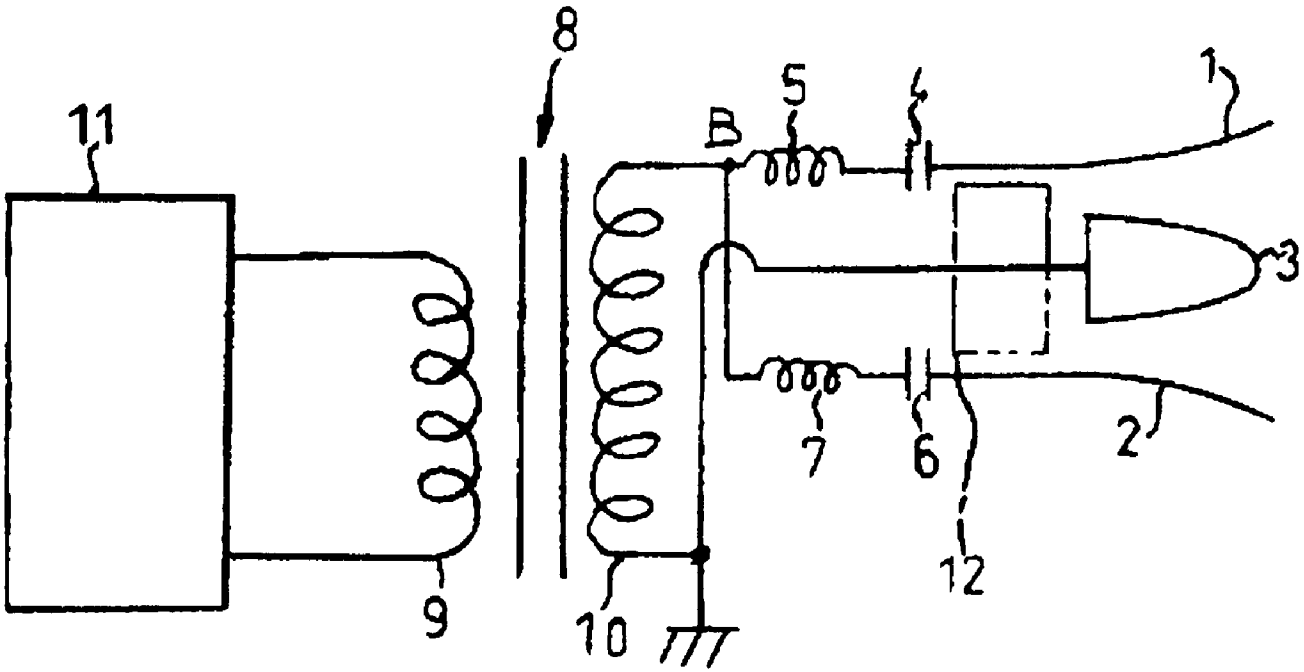
FIG. 1 is an outlined schematic diagram of a plasma generating apparatus of one embodiment of the present invention.

1 electrode
2 electrode
3 common electrode
4 condenser
5 coil
6 condenser
7 coil
8 high frequency transformer
9 primary coil
10 secondary coil
11 power supply circuit
40 electrode
41 electrode
42 electrode
43 electrode
44 ground side electrode
46 ground side electrode
55 high frequency transformer
56 primary coil
57 secondary coil
60 outer circumferential portion
61 center portion
62 fluid passageway
64 fluid sending device
65 wire material
65 wire material
67 box body
70 electrode pair
71 electrode
72 electrode
80 powder plasma processing portion
81 material inflow portion
82 nozzle
83 air inflow portion
84 plasma generating portion
85 plasma generating portion
86*a* electrode
86*b* ground side electrode

86*c* nozzle portion
86*d* nozzle portion
87 lower portion duct
90 powder collecting portion
93 blower
100 power supply circuit
101 primary coil
102 secondary coil
103 high frequency transformer
104 electrode
105 electrode
106 object to be processed
107 condenser
110 condenser
111 electrode
112 common electrode
113 electrode
114 condenser
115 condenser
200 power supply circuit
201 high frequency transformer
202 primary side coil
203 secondary side coil
300 plasma generating apparatus
301 work
302 plasma irradiating zone
400 plasma generating apparatus
401 transfer driving mechanism
402 control device
403 work
500 first electrode
502 second electrode
504 plasma
506 dielectric

BEST MODE FOR CARRYING OUT THE INVENTION

The embodiments of the power supply circuit for plasma generation, the plasma generating apparatus and the plasma processing apparatus of the present invention are described in detail according to the accompanying drawings as follows.

FIG. 1 is an outlined schematic diagram of a plasma generating apparatus of one embodiment of the present invention. This plasma generating apparatus includes two pairs of electrode that are constructed from the electrode 1, 2 opposed to the ground side common electrode 3. The alternating high voltage occurred by the alternating high voltage generating circuit comprising of power supply circuit 11 and the high frequency transformer 8 is applied to each electrode 1, 2. Said power supply circuit 11 includes the inverter circuit which converts the commercial power supply to about 30 kHz high frequency pulse voltage. The high frequency pulse voltage formed by this inverter circuit is introduced into the primary coil 9 of high frequency transformer 8, and is raised up to about several thousand to ten thousand Volt, so that it is output as the alternating high voltage from the secondary coil 10. One output side of secondary coil 10 is connected in common to the electrodes 1, 2 and the other output side is grounded. The LC series circuit composed of condenser 4 and coil 5, and the LC series circuit composed of condenser 6 and coil 7 are interposed between the common connection B and each of electrodes 1 and 2, respectively. The value of electric capacity (capacitance) of each condenser and the value of inductance of each coil are chosen by considering of the conditions such as applied voltage value of high frequency transformer 8, quantity of electric discharge and space capacity between electrode 1, 2 and electrode 3, and for example, their values are chosen as 100 pF for each electric capacity and 100 mH for each coil. Each condenser is connected to the discharge open end side of each electrode and each coil is connected to the common connection B. When air blow is supplied to the plasma occurred between each electrode 1, 2 and common electrode 3, the used air blow generator 12 is arranged in the vicinity of each electrode.

Figure 2:
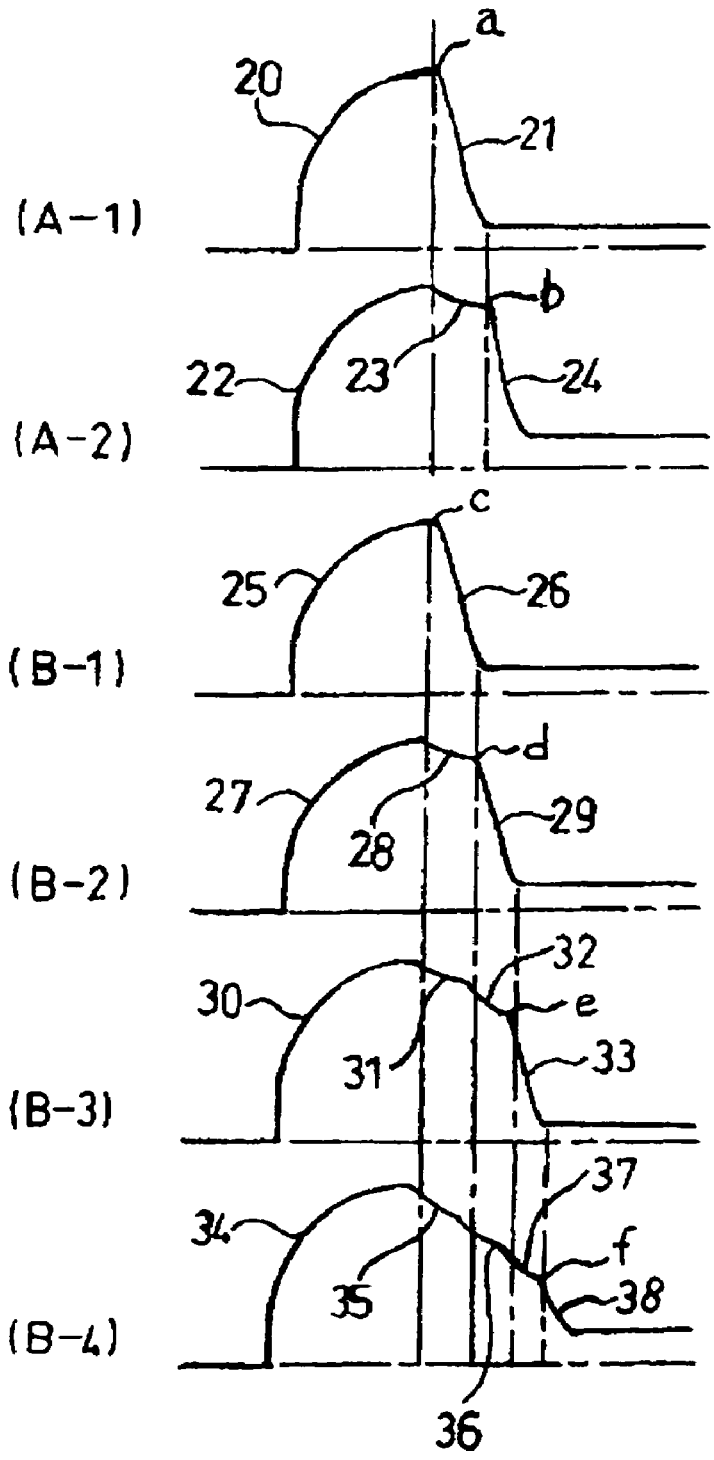
FIG. 2 is a wave pattern model diagram to explain a state of charge and discharge of condenser in the present invention.

In the plasma generating apparatus configured above, when the electric discharge occurs between electrode 1 and common electrode 3, the discharge occurs at condenser 4 of electrode 1 side. The electric discharge phenomenon of this time is shown as the wave pattern model diagram of FIG. 2 (A-1). The charge voltage 20 of condenser 4 suddenly falls from discharge point a as shown in said diagram. At this time, by means of coil 5 interposed near common connection B, the voltage drop of the common connection B is restrained. At the time of discharge of condenser 4, the behavior of condenser 6 of other electrode 2 is shown in FIG. 2 (A-2). As the voltage drop at common connection B is restrained by means of coil 5 at the time of said discharge, the charge voltage 22 of condenser 6 falls only a little and is held at dischargeable electric potential during discharging of condenser 4 from electric discharge point a as shown by numeral 23, so that the discharge of condenser 6 occurs at discharge point b as shown by numeral 24. Therefore, immediately after discharge between electrode 1 and common electrode 3, the discharge between electrode 2 and common electrode 3 is induced. After that time, the voltage turns over, and by repeating such charging and discharging, the continual plasma generation is enabled due to electrode 1 and common electrode 3, and electrode 2 and common electrode 3. In addition, in unused time, bypass resistance for preventing the electric shock based on the remaining charge of each condenser may be connected in parallel to condenser 4 and 6.

As described above, according to the plasma generating apparatus constituted above, the plasma generation by two electrode pairs can be performed smoothly by means of single alternating high voltage generating circuit. Therefore, the plasma generating apparatus suitable for a large quantity of plasma generation can be composed cheaply without jumboizing.

Figure 3:
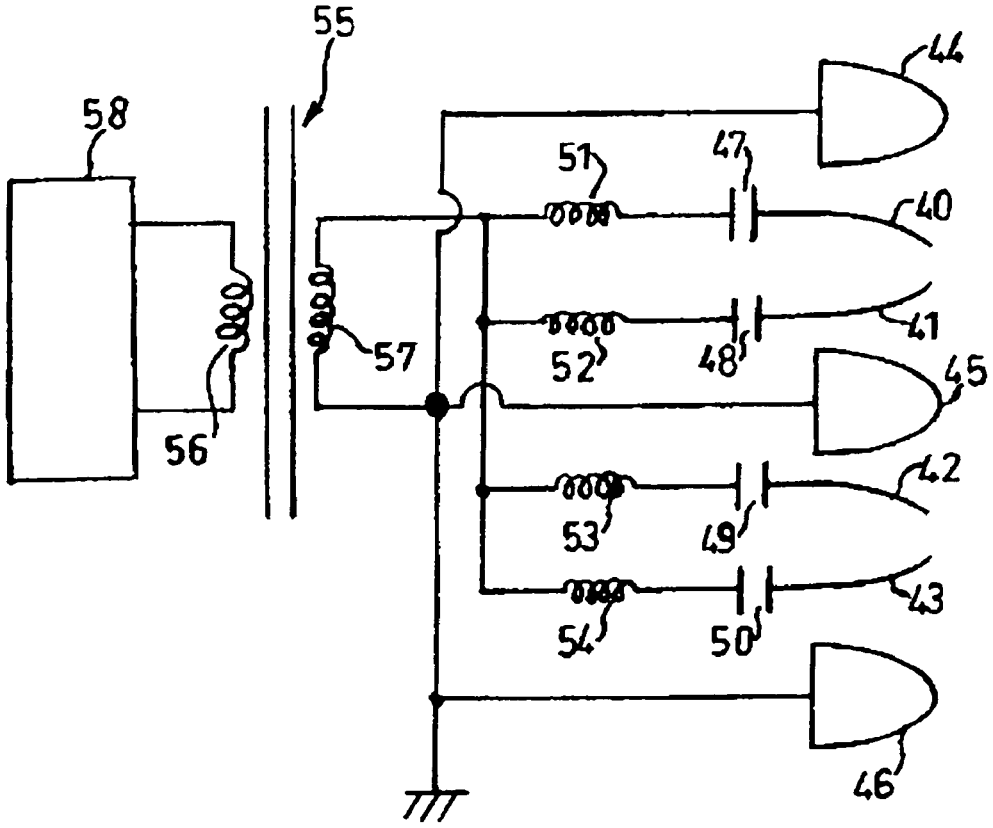
FIG. 3 is an outlined schematic diagram of a plasma generating apparatus of another embodiment of the present invention.

FIG. 3 is the outlined schematic diagram of the compounded plasma generating apparatus which id adjacently provided four pairs of electrode pair. The high frequency pulse voltage of power supply circuit 58 is introduced into the primary coil 56 of high frequency transformer 55, and the raised voltage is output as alternating high voltage from the secondary coil 57. Four electrodes 40 to 43 are connected in common to one output side of secondary coil 57, and the other output side is grounded. The electrodes 40, 43 are disposed so as to face with the ground side electrode 44, 46, respectively. The electrodes 41, 42 are disposed to face with the ground side common electrode 45. The LC series circuits such as condenser 47 and coil 51, condenser 48 and coil 52, condenser 49 and coil 53,and condenser 50 and coil 54 are interposed between each of electrodes 40 to 43 and secondary coil 57, respectively.

By means of insertion of LC series circuit, the plasma can be smoothly generated same as the embodiment of FIG. 1. When the electric discharge occurs between electrode 40 and ground side electrode 44, the discharge of condenser 47 of electrode 40 side arises. The discharge phenomenon of this time is shown in wave pattern model diagram of FIG. 2 (B-1). The charge voltage 25 of condenser 47 suddenly falls from electric discharge point c as shown in numeral 26 of this diagram. At this time, the voltage drop is restrained by means of coil 51. When condenser 47 discharges, the behavior of condenser 48 at another one electrode 41 is shown in FIG. 2 (B-2). Since the voltage drop is restrained by means of coil 52, the charge voltage 27 of condenser 48 falls only a little and is held at dischargeable electric potential during discharging of condenser 47 from electric discharge point c as shown by numeral 28 of this diagram, so that the discharge occurs at discharge point d as shown by numeral 24 of the diagram. Therefore, immediately after discharge due to electrode 40, the discharge at electrode 41 is induced, too. Moreover in the same manner, in the condenser 49 of electrode 42 side, the discharge occurs at discharge point e being late a little from discharge point d according to wave change shown in numerals 30 to 33. In addition, likewise, in the condenser 50 of electrode 43 side, the discharge occurs at discharge point f being late a little from discharge point e according to wave change shown in numerals 34 to 38. By repeating such charge and discharge, the discharge due to four pairs of electrode pair occurs in a chain reaction, so that the plasma generation can be performed smoothly.

Though the examples of two pairs and four pairs of electrode pair are shown in FIG. 1 and FIG. 2, respectively, the number of electrode pair is not necessary to be even number, and there is not a limit of said number basically. Furthermore, plural electrodes may correspond to said one electrode. For example, in FIG. 1, two pairs of electrode are composed of two high voltage electrodes and one ground electrode.

In the plasma generating apparatus of said constitution, the plasma generation due to four electrode pairs can be performed smoothly by means of single alternating high voltage generating circuit comprising power supply circuit 58 and high frequency transformer 55, the plasma generating apparatus suitable for a large quantity of plasma generation can be composed cheaply without jumboizing by using of four pairs of electrode pair. Besides, since the electrodes 40 to 43 are connected in common to second coil 57 side, the power supply constitution of secondary coil 57 side can be simplified, so that this technique is contributed to reduction in cost, still more.

Figure 4:
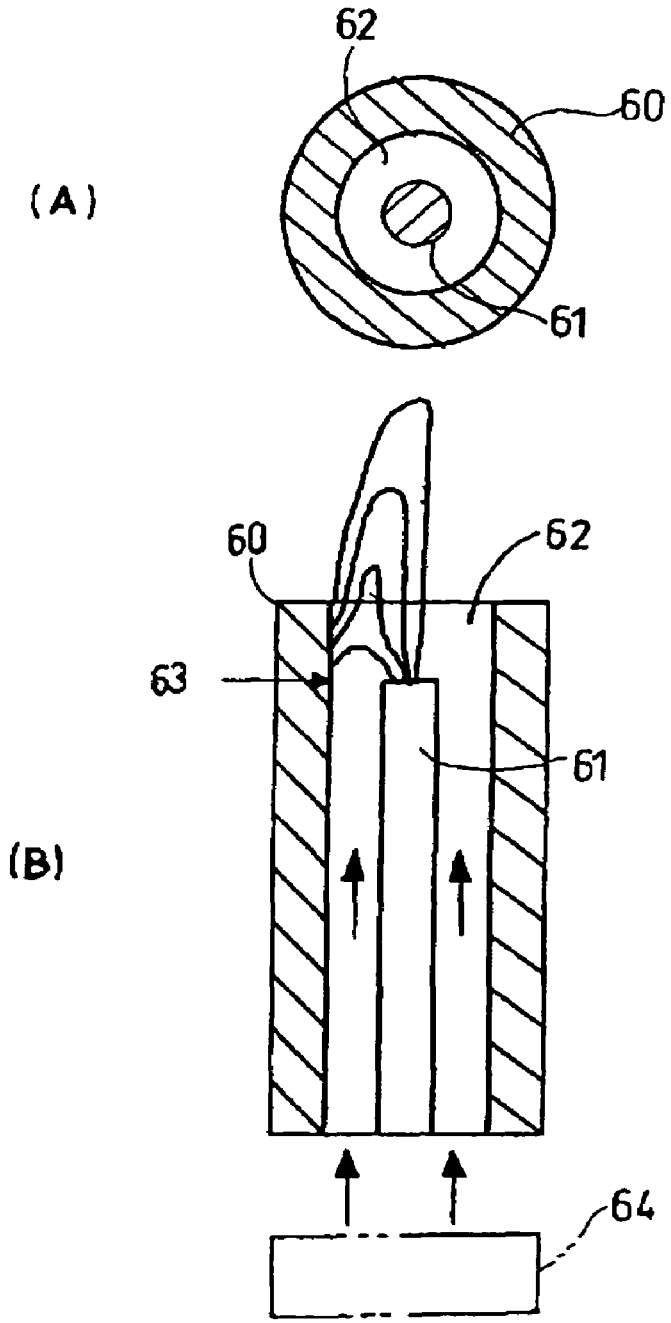
FIG. 4 is a sectional diagram which shows an example of each electrode pair employed in the embodiment of FIG. 1 or FIG. 2.

FIG. 4 illustrates an example of concrete constitution of each electrode pair employed in the embodiments of FIGS. 1 and 3. FIG. 4(A) and FIG. 4(B) show the cross section shape and the longitudinal section shape, respectively. One pair of electrode is arranged at the outer circumferential portion 60 and center portion 61 of coaxial cylinder. The cylindrical space formed between electrodes of the outer circumferential portion 60 and the center portion 61 is fluid passageway 62 of air flow etc. The fluid such as air and processing gas is introduced into said fluid passageway 62 by means of fluid sending device 64. The fluid may be a laminar flow or a turbulence, but when a laminar flow is formed, the fluid is introduced through a rectifier. The nozzle jet shape can be arranged by means of a coaxial form of this electrode pair, and the nozzle portion of nozzle type or blowtorch type can be composed in the plasma generating apparatus. The discharge occurs from the neighborhood of electrode tip arranged in center portion 61, and is emitted outwards. However, it may be composed to discharge from an intermediate portion of center portion 61. When this nozzle portion is applied to each electrode pair of plural electrode pairs of FIG. 1 or FIG. 3 and each nozzle portion is provided with a predetermined form, the plasma generation range can be magnified and the desired plasma generation range can be formed.

Figure 5:
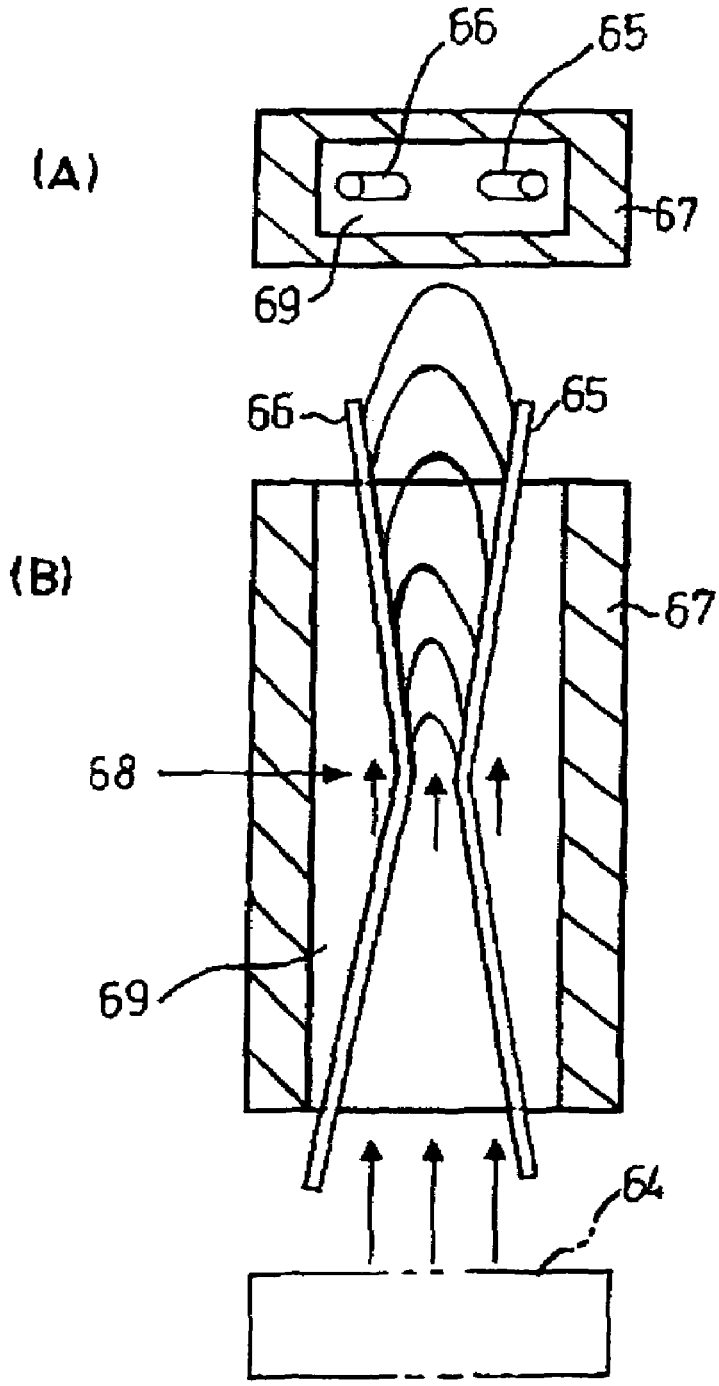
FIG. 5 is a sectional diagram which shows another example of each electrode pair employed in the embodiment of FIG. 1 or FIG. 2.

FIG. 5 shows an another example of the concrete constitution of electrode pair available for the embodiment of FIG. 1 or FIG. 3. FIG. 5(A) and FIG. 5(B) show the cross section shape and the longitudinal section shape, respectively. It faces each other one pair of electrode, which is formed from the wire material 65 spread at the tip end side and is contained in the insulative box body 67 opened at the top and the bottom. The hollow center of box body 67 configures the fluid passageway 62 of air etc. from which air or processing gas are introduced by the fluid sending device 64. As for wire material 65, 66 of electrode pair, their space becomes small inside the box body 67, and the narrow portion 68 becomes a discharge start point. The generated plasma is emitted in a planar form from the tip exit by receiving a fluid flow from the fluid sending device 64. When the planar nozzle portion constructed above is applied to each electrode pair of plural electrode pairs of FIG. 1 or FIG. 3 and each nozzle portion is provided with a predetermined form, the plasma generation range can be magnified and the desired plasma generation range can be formed.

Figure 6:
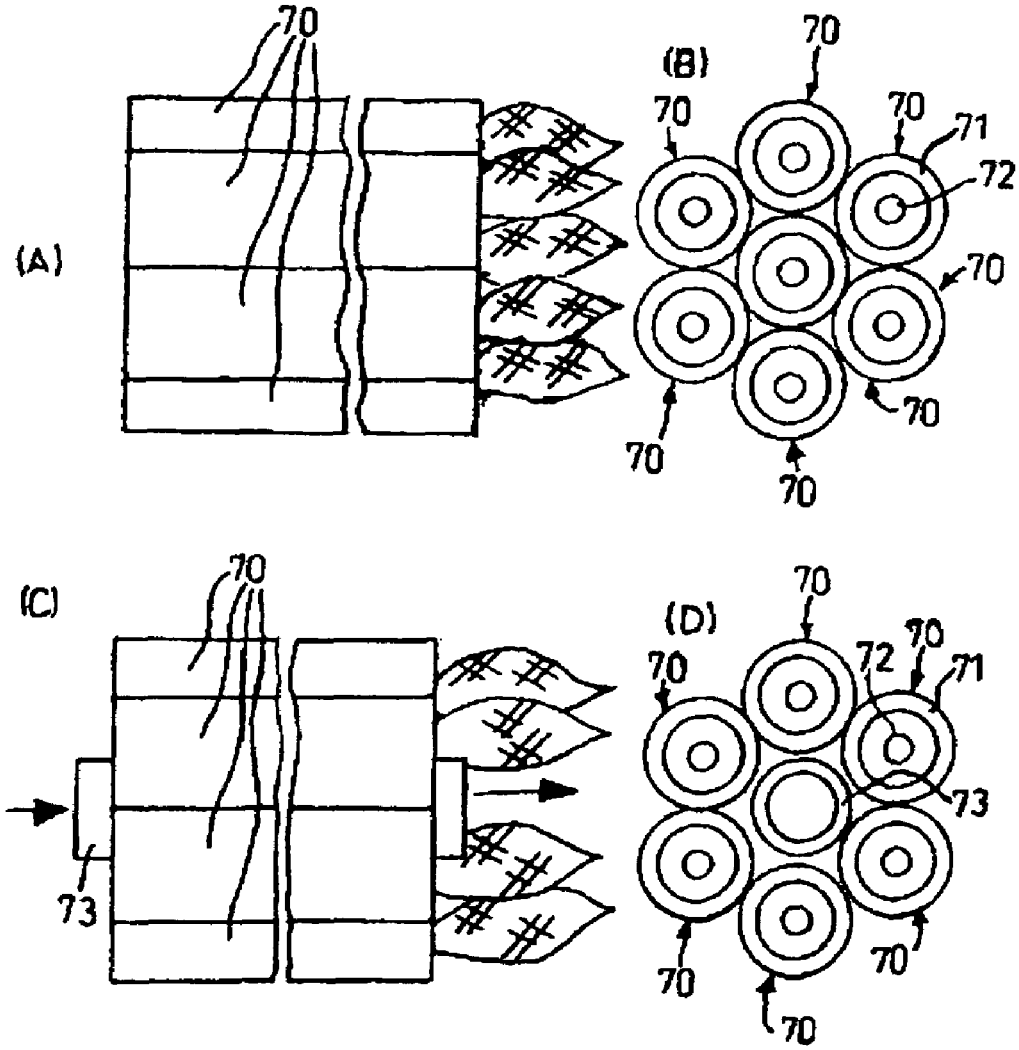
FIG. 6 is a sectional diagram showing a compound plasma generating apparatus hanging to the present invention.

FIG. 6 shows the concrete shape example of the compound plasma generating apparatus comprising plural electrode pairs of the present invention. FIGS. 6(A) and 6(B) shows the embodiment forming the aggregate of electrode pair in which the electrode pair 70 of coaxial nozzle shape of FIG. 4 is assembled by bundling seven pairs. Each electrode pair 70 is constructed from the electrode 71 of cylindrical outer circumferential portion and the electrode 72 of center portion. In the same manner as embodiment of FIG. 1 or FIG. 3, seven pairs of electrode pair are constituted so as that LC series circuit is interposed between one electrode side of each electrode pair and power supply transformer, so that plasma generation can be performed smoothly by the restraint operation of voltage drop of LC series circuit, as described before. Therefore, the plasma generating apparatus with strong plasma irradiation ability can be provided by the aggregate of said electrode pair. FIGS. 6(C) and 6(D) shows the embodiment forming the aggregate of electrode pair in which the electrode pair 70 of coaxial nozzle shape of FIG. 4 is assembled by bundling six pairs and the fluid feed passageway 73 of air or object to be processed etc. is disposed in the center portion. In this case, it can be provided the plasma generating apparatus with several effects that the strong plasma irradiation ability is comprised by the aggregate of electrode pair and the processing use can be magnified by supplying fluid or object to be processed through the fluid feed passageway 73.

Figure 7:
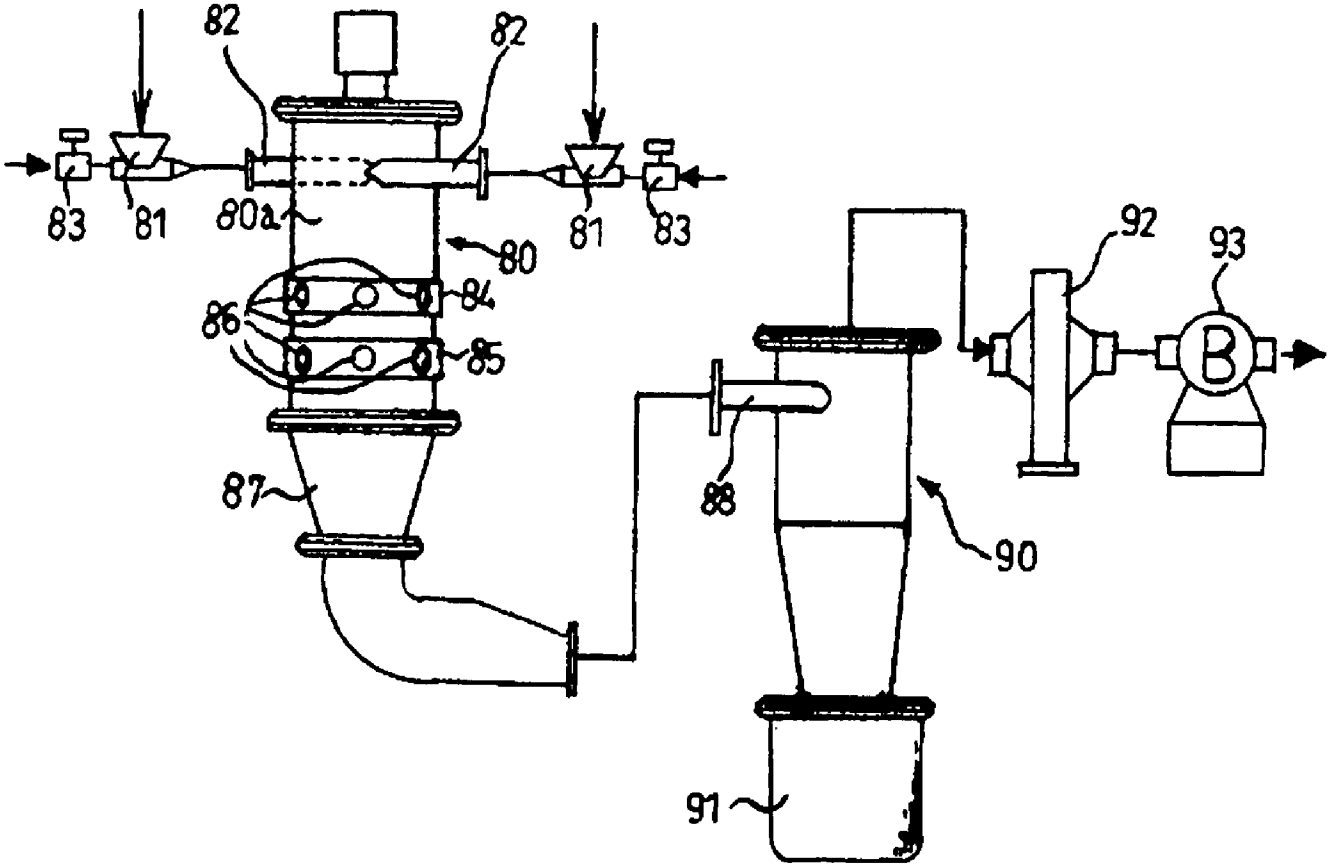
FIG. 7 is an explanatory diagram to show the total constitution of a plasma processing apparatus for powders of the present invention.
Figure 10:
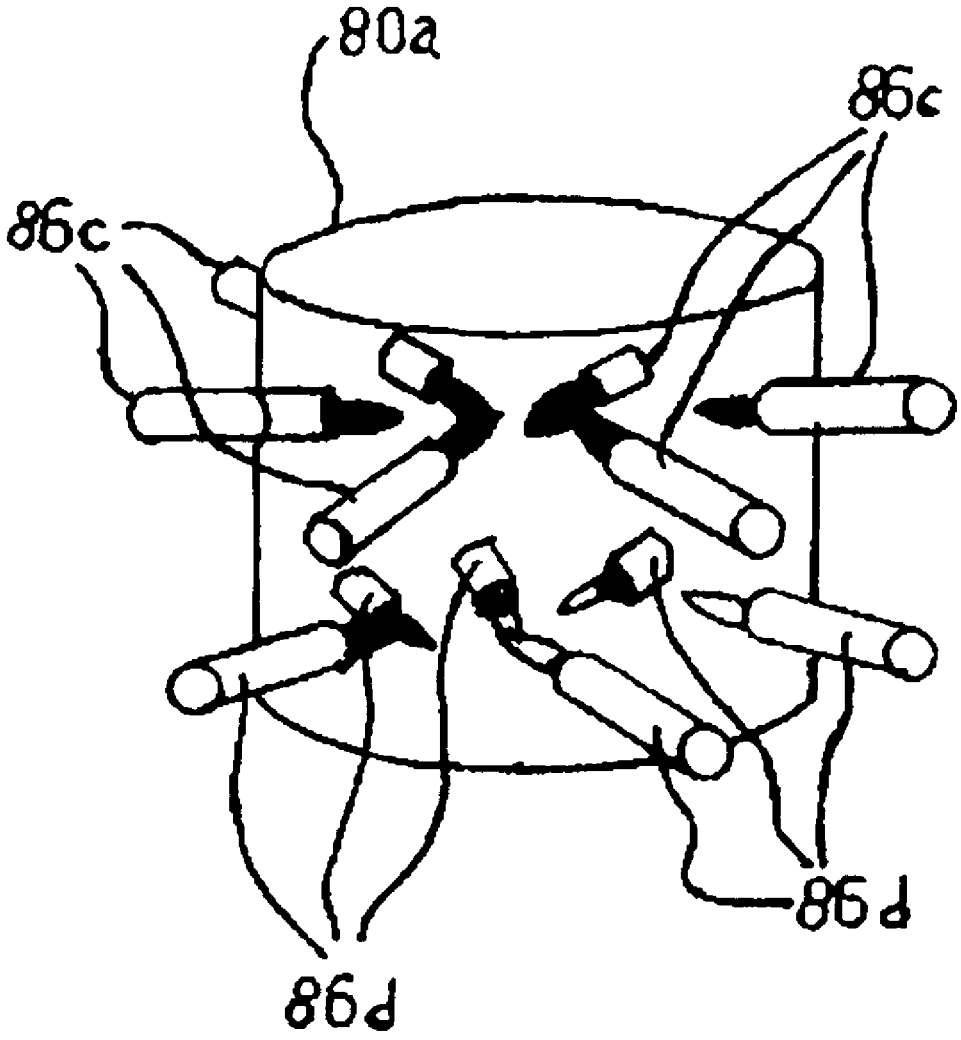
FIG. 10 is an outlined perspective diagram showing an arrangement state of nozzle portion in the plasma processing apparatus for powders of FIG. 7.
Figure 11:
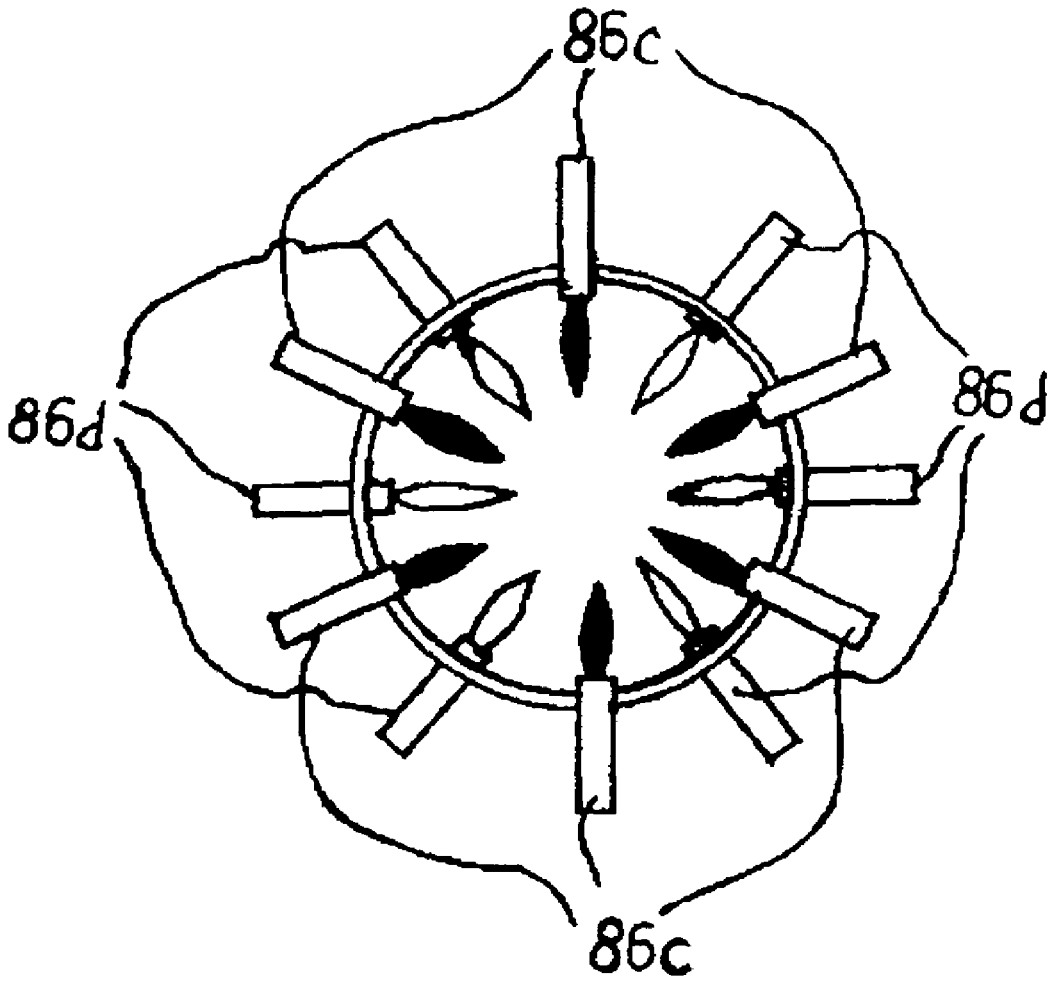
FIG. 11 is an outlined plane diagram showing an arrangement state of nozzle portion in the plasma processing apparatus for powders of FIG. 7.

Next, an embodiment of the plasma surface treatment apparatus which applys the present invention to plasma surface treatment of powder such as toner material is explained. FIG. 7 is the explanatory diagram to show the total constitution of the plasma processing apparatus for powders of the present invention. Said plasma processing apparatus for powders consists of powder plasma processing portion 80 and powder collecting portion 90. The powder material to be processed is cast into material inflow portion 81, and is introduced into the upper part of powder plasma processing portion 80 from nozzle 82 by receiving air supply from air inflow portion 83. After the introduced powder material to be processed was performed the plasma surface treatment while dropping in powder plasma processing portion 80, the processed powder is conveyed toward collection tank 91 of powder collecting portion 90 through lower portion duct 87 of powder plasma processing portion 80 based upon exhaust operation by blower 93 from upper part of powder collecting portion 90. The powder plasma-processed in powder plasma processing portion 80 is introduced into the upper part of powder collecting portion 90 from collection opening 88, and is fallen and collected into collection tank 91 while unnecessary gas is exhausted by blower 93. The HEPA filter device 92 (high efficiency particulate air filter) is arranged before absorption opening of pump 93. Two levels of plasma generating portion 84, 85 are installed up and down in processing portion 80*a* of powder plasma processing portion 80. Introduction portion 86 installing six plasma generating apparatuses with nozzle type and cylinder shape shown in FIG. 4 is disposed in each plasma generating portion 84, 85. As shown in FIG. 10 and FIG. 11, six nozzle portions 86*c* of upper level plasma generating apparatuses and six nozzle portions 86*d* of lower level plasma generating apparatuses are disposed to face radially and uniformly under plane view, so that the plasma processing region which can be irradiated uniformly in the tank of the powder plasma processing portion 80 is formed three-dimensionally. Carrier gas feed mechanism (not shown) generating a plasma stream downwardly is arranged in the powder plasma processing portion 80. For this carrier gas, non-active gas such as He, Ar and N2 is preferred, but gas which does not give the influence to plasma processing is chosen as well as air. When this plasma processing is performed in the atmosphere, air is the simplest as carrier gas. In use example of this plasma surface treatment apparatus, for example when toner material is carried into powder plasma processing portion 80, fine pelletization treatment of said toner material can be performed through dropping and passing in the plasma generated by each plasma generating portion 84, 85.

Figure 8:
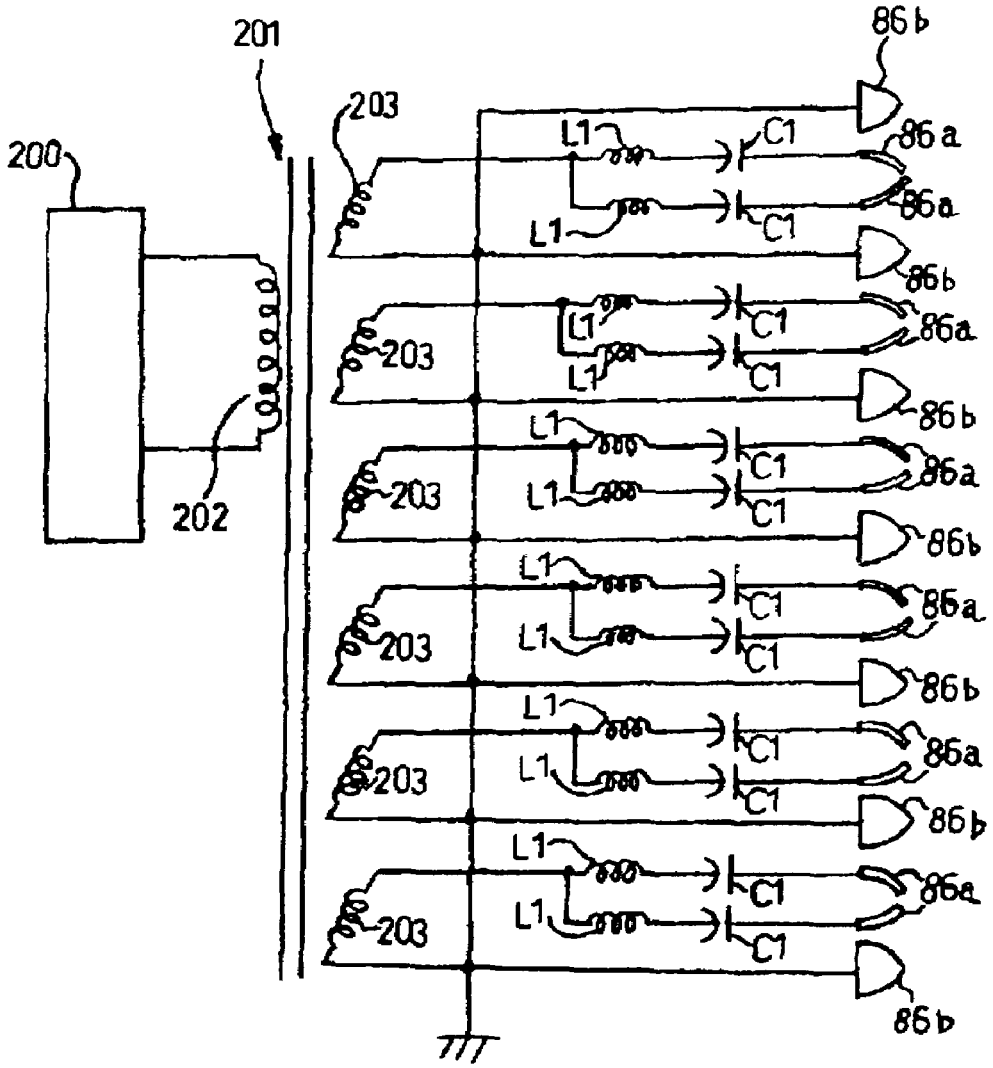
FIG. 8 is an outlined schematic diagram of the plasma generating apparatus in the plasma processing apparatus for powders of FIG. 7.

FIG. 8 is an outlined schematic diagram of the power supply circuit for plasma generation and the plasma generating apparatus in the plasma processing apparatus for powders of FIG. 7. Of course, this outlined constitution is available for not only the plasma processing apparatus for powders but also another various uses. In this arrangement, plural windings are set for the second side coil of high frequency transformer, and plural electrode pairs are connected to each coil (winding). In other words, in this arrangement, the plasma generation of the number of n×m is possible by the second side coils (windings) of the number of n and the electrode pairs of the number of m connected to said one coil. Therefore, the plasma of large area and large volume becomes possible. In FIG. 8, it is n=6 and m=2, but there are not these numerical limits.

Figure 9:
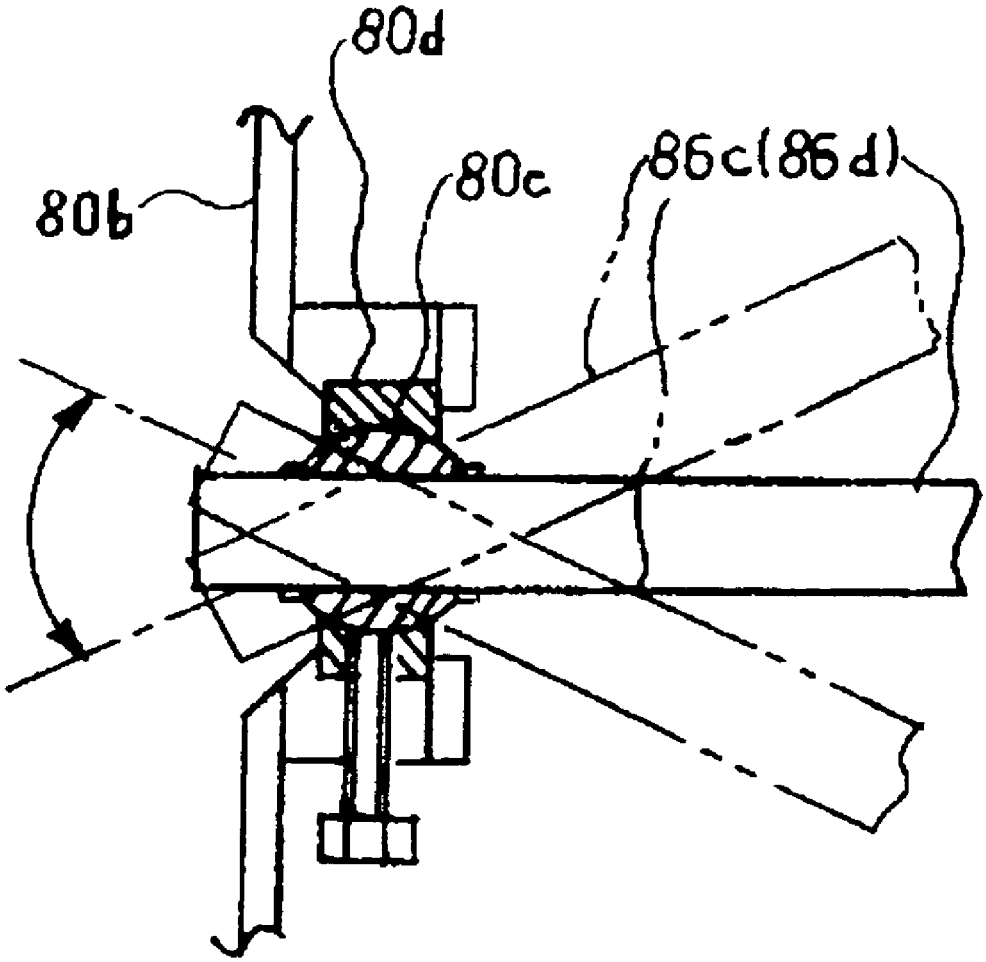
FIG. 9 is a sectional diagram showing an installation state of nozzle portion available for the plasma processing apparatus for powders of FIG. 7.
Figure 12:
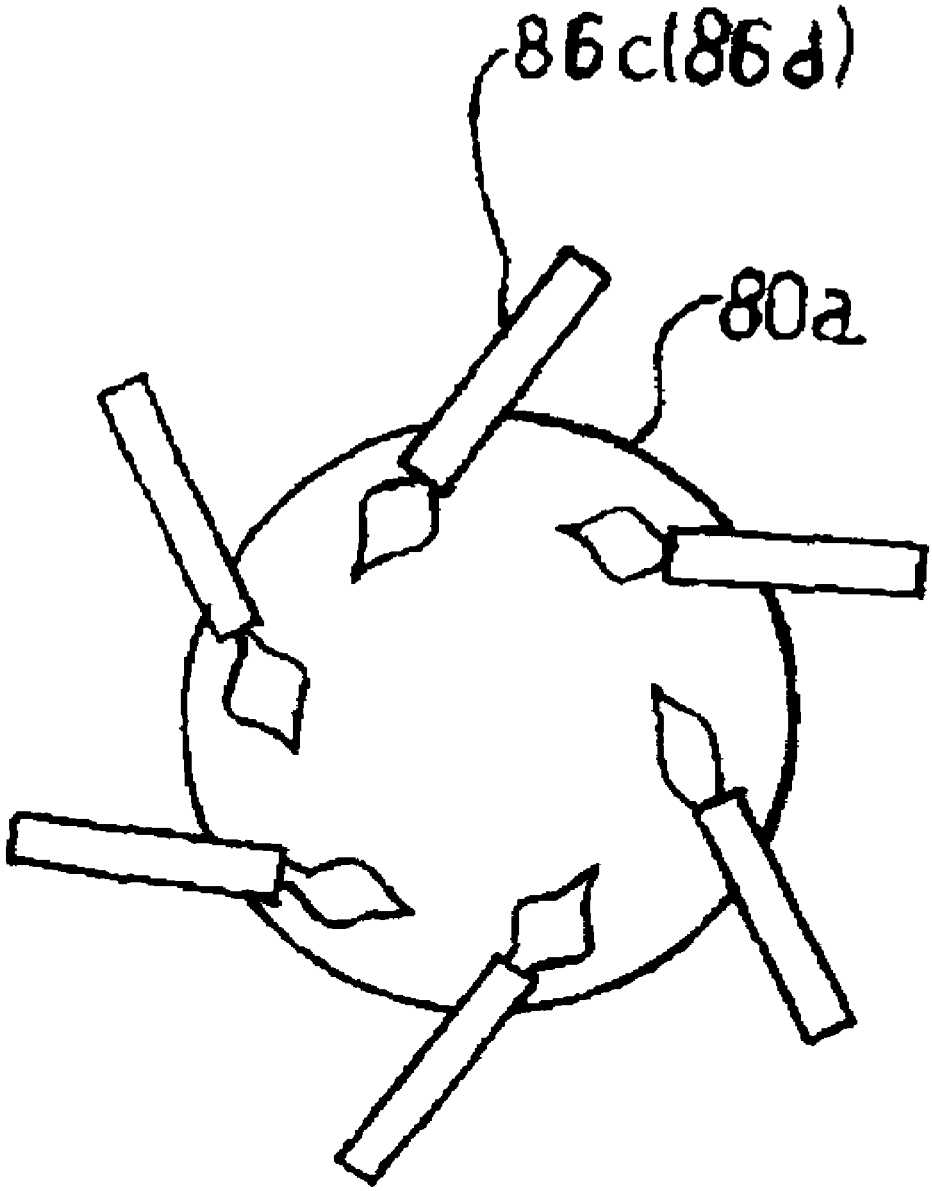
FIG. 12 is an outlined plane diagram showing another arrangement state of nozzle portion in the plasma processing apparatus for powders of FIG. 7.

FIG. 9 is a sectional diagram showing an installation state of nozzle portion available for said plasma processing apparatus for powders. FIG. 10 is an outlined perspective diagram showing an arrangement state of nozzle portion in said plasma processing apparatus for powders. FIG. 11 is an outlined plane diagram showing an arrangement state of nozzle portion in said plasma processing apparatus for powders. In addition, FIG. 12 is an outlined plane diagram showing another arrangement state of nozzle portion in said plasma processing apparatus for powders.

In FIG. 8 to FIG. 12, it is shown the outlined constitution of the plasma generating apparatus for powders comprising of the upper level nozzle portion 86*c* and the lower level nozzle portion 86*d* arranged at the plasma generating portion 84, 85, respectively. Each of the upper level nozzle portion 86*c* and the lower level nozzle portion 86*d* consists of the electrode pair of power supply transformer side electrode 86*a* and ground side electrode 86*b*. Alternating high voltage is applied to each electrode 86*a* by the alternating high voltage generating circuit comprising of power supply circuit 200 and high frequency transformer 201 connected to said power supply circuit 200 by primary coil 202. Additionally, in the same manner as the embodiment of FIG. 1 or FIG. 3, LC series circuit composed of condenser C1 and coil L1 is interposed between each electrode 86*a* and second side coil 203 of high frequency transformer 201.

The powder plasma processing apparatus constructed above comprises 12 electrode pairs in total, and by interposing LC series circuit composed of condenser C1 and coil L1 at each electrode 86*a* side, the discharge in each electrode pair is smoothly generated same as the embodiment of FIG. 1 or FIG. 3, so that a large quantity of plasma can be generated inside the powder plasma processing portion 80. Therefore, by common use of alternating high voltage generating circuit composed of power supply circuit 200 and high frequency transformer 201, it can be realized the plasma surface processing apparatus which can perform the surface treatment cheaply by high output plasma. Besides, since each plasma generating portion 84, 85 divided into two levels can be installed in the powder plasma processing portion 80, expansion of powder processing capacity can be planned. In addition, as indicated in FIG. 10 and FIG. 11, upper level nozzle portion 86*c* and lower level nozzle portion 86*d* are disposed to face each other respectively, and when each nozzle portion 86*c*, 86*d* are arranged so as to emit their plasma spirally as shown in FIG. 12, the plasma circling flow like vortex flow can be formed in the powder plasma processing portion 80, so that the plasma surface treatment suitable for agitation effect and uniform irradiation can be performed. Additionally, if the direction of each nozzle portion can be changeably supported as shown in FIG. 9, irradiation form can be freely changed to the opposed irradiation of FIGS. 10 and 11 or the spiral irradiation of FIG. 12 so that it gets possible to cope for many uses. As shown in FIG. 9, when link ball 80*c* is fitted in the vicinity of plasma output portion of each nozzle portion 86*c*, 86*d* and is installed in ball support portion 80*d* disposed in inner wall portion 80*b* of powder plasma processing portion 80, said nozzle portion 86*c*, 86*d* can be arranged so as that its direction can be changeably adjusted in the angle range of about 50° around the center of link ball 80*c* freely. By using of universal joint member replacing with link ball 80*c*, the direction free structure can be obtained similarly.

Furthermore, an embodiment of the present invention suitable for surface processing is explained.

Figure 13:
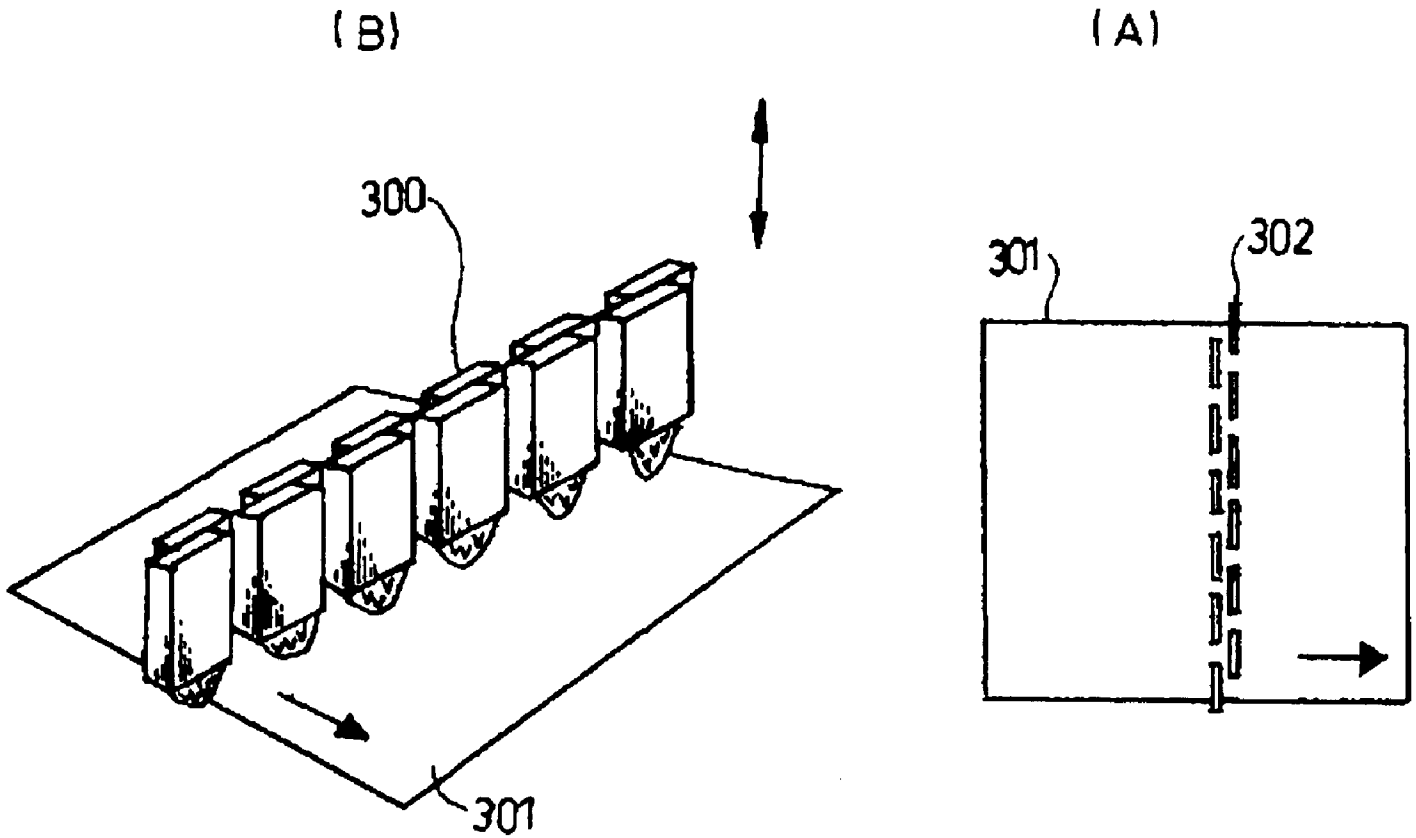
FIG. 13 is a diagram showing the line-shaped plasma processing apparatus applied the present invention.

FIG. 13 shows a line-shaped plasma surface processing apparatus irradiating plasma against object to be processed (work) in a line shape. FIG. 13 (A) is an appearance perspective diagram of important portion. Each plasma generating apparatus 300 is, for example, the plasma generating apparatus of FIG. 4 or FIG. 5, and said line-shaped plasma surface processing apparatus is arranged so as that two lines of thing which adjacently disposed plural plasma generating apparatuses 300 to one line are placed each other with a little shift so as to make irradiation plasma dense in a transfer direction of work 301. As shown in the same figure (B), since the plasma irradiating zone 302 of each line overlaps each other against the transfer direction of work 301, irradiation is even in the transfer direction and the uniform plasma processing can be performed. The whole line-shaped plasma surface processing apparatus may be transferred in a predetermined direction without moving work 301, and either of them may transfer relatively. In addition, in the same manner as embodiment of FIG. 1, FIG. 3 or FIG. 7, plural plasma generating apparatus 300 are constituted so as to use in common the alternating high voltage generating circuit producing the alternating high voltage applied to each electrode pair, so that it can be constructed at low cost and can contribute to reduction of the plasma surface processing cost.

Figure 14:
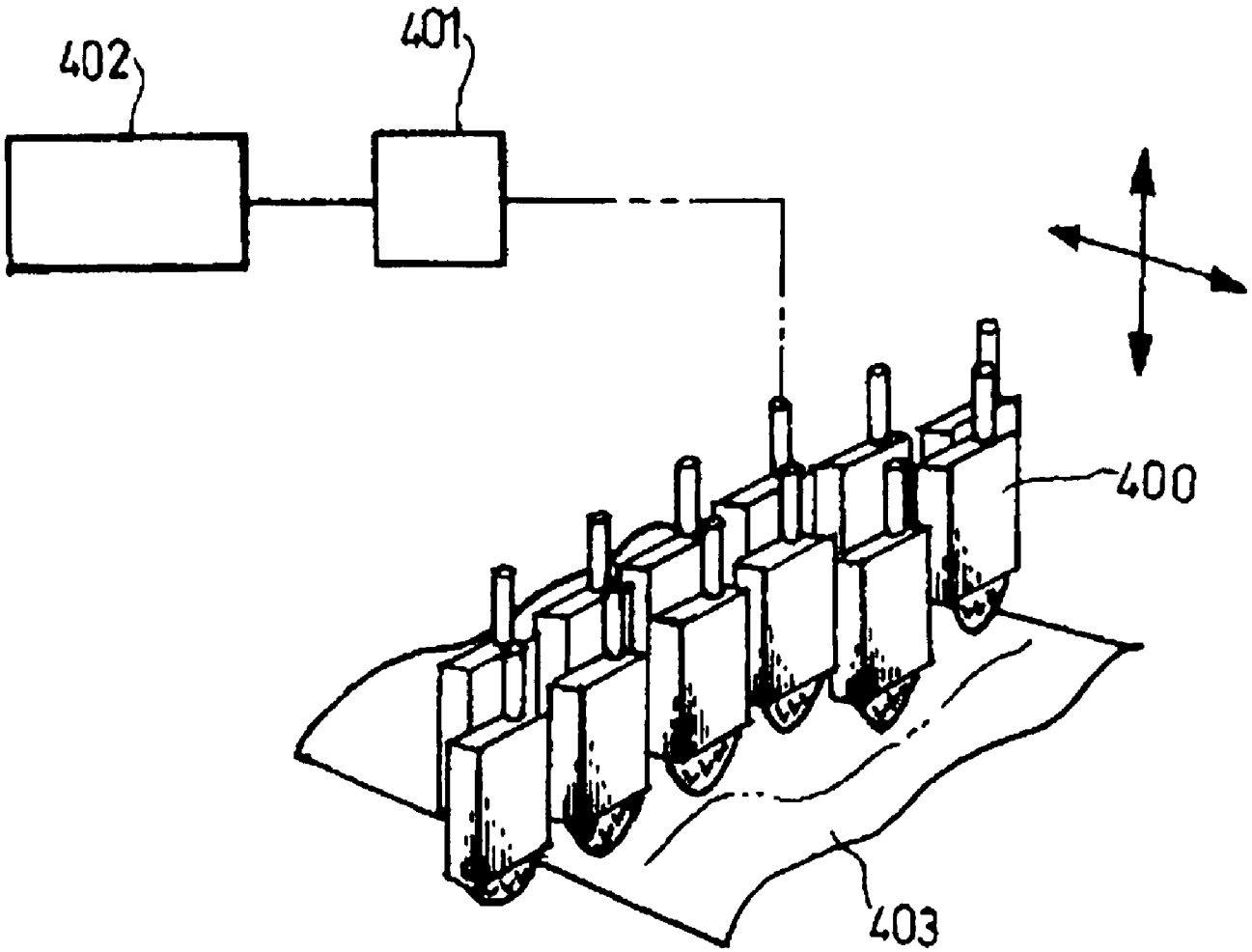
FIG. 14 is a diagram showing the mobile plasma processing apparatus applied the present invention.

FIG. 14 is an embodiment of the present invention suitable for cases in which when the plasma is irradiated to a substance having intense unevenness and a work having curved surface with ups and downs. In comparison with FIG. 13, this embodiment is the movable plasma processing apparatus in which each individual of plural plasma generating apparatuses 400 adjacently provided can move independently in top and bottom and in right and left. Each plasma generating apparatus 400 can move to top and bottom or to right and left by means of transfer driving mechanism 401 driven under control operation by control device 402. The work surface is observed by means of surface detector unit (not illustrated) of work 403 such as CCD camera, reflection type infrared sensor and needle contact sensor. Because the detected information is supplied to control device 402, the control device 402 determines the most suitable irradiating distance and position to the work surface and each plasma generating apparatus 400 is moved, so that the plasma surface treatment for the work with uneven surface can be performed with high precision. Besides, in the same manner as the embodiment of FIG. 13, since the plural plasma generating apparatus 400 is constituted so as to use in common the alternating high voltage generating circuit which can apply the alternating high voltage to each electrode pair, this apparatus can be composed with low cost and can contribute to reduction of the plasma surface treatment cost.

The plasma processing apparatus of the present invention can be applied to the process such as shape transformation, pelletization, chamfering, surface roughening and projection removal of solid material like toner, glass, ceramics, metal, semiconductor, plastic, rubber and elastomer.

In addition, the plasma processing apparatus of the present invention can produce the object given the surface processing such as surface reforming, wettability improvement, cleaning, etching, resist stripping, painting, printing, print preprocessing, coating, evaporation, application, layer preprocessing, seal, sealing, joining, adhesion preprocessing, oxidization-resisting reinforcement, and reduction-resisting reinforcement. Moreover, the plasma processing apparatus of the present invention can provide the object of solid with the surface membrane such as metal membrane, electroconductive • insulative • semiconductive ceramics membrane (oxide membrane, nitride membrane, carbide membrane etc: for example, aluminium oxide membrane, silicon oxide membrane, zinc oxide membrane, ITO (indium tin oxide membrane), ATO (antimony tin oxide membrane), dielectric membrane (barium titanate etc.), piezoelectric substance (PZT, AIN, ZnO etc.), magnetic substance membrane), superconductor membrane, diamondlike carbon membrane (called DLC, amorphous carbon membrane, or diamond-like carbon membrane), polymer • resin • plastic membrane, and fluoride membrane. Furthermore, the plasma processing apparatus of the present invention can provide the object performed processing such as effluent gas processing of NOx or SOx, sterilization, pasteurization, washing, deodorization, waste oil disposal, polluted thing disposal of dioxin, and ozone disposal. Additionally, it can produce the carbon system nanoparticle synthesized by plasma processing as object such as carbon nanotube, carbon nanocoil, carbon nanotwist, carbon nanohorn, and fullerene, and can also produce the functional particle as object such as titanium oxide, barium titanate, lithium manganate, lithium cobalt oxide, lithium nickel oxide, zinc oxide and silicon oxide.

The above-mentioned plasma apparatus was described as an apparatus to generate a pulse arc discharge (generally called a grinding arc) under an atmospheric pressure. However, the power supply circuit of the present invention is available for a barrier discharge occurring in dielectric interposed between electrodes, and to discharge power supply circuit in the present invention (called dielectric discharge or silent discharge) and a vacuum discharge, and it is needless to say that said power supply circuit can be used for various applications such as surface treatment and effluent gas process with the use of said plasma. For example, in the case of barrier discharge, the discharge apparatus in which plural high voltage electrodes are disposed for ground electrode can be driven by one power supply. In addition, even in the case of vacuum discharge, since a vacuum device is assigned as one ground anode and plural high voltage electrodes can be disposed in said vaccum chamber, a large capacity of glow discharge can be occurred, so that it is available for processing of objects such as large-scale object to be processed and board of big area.

Figure 15:
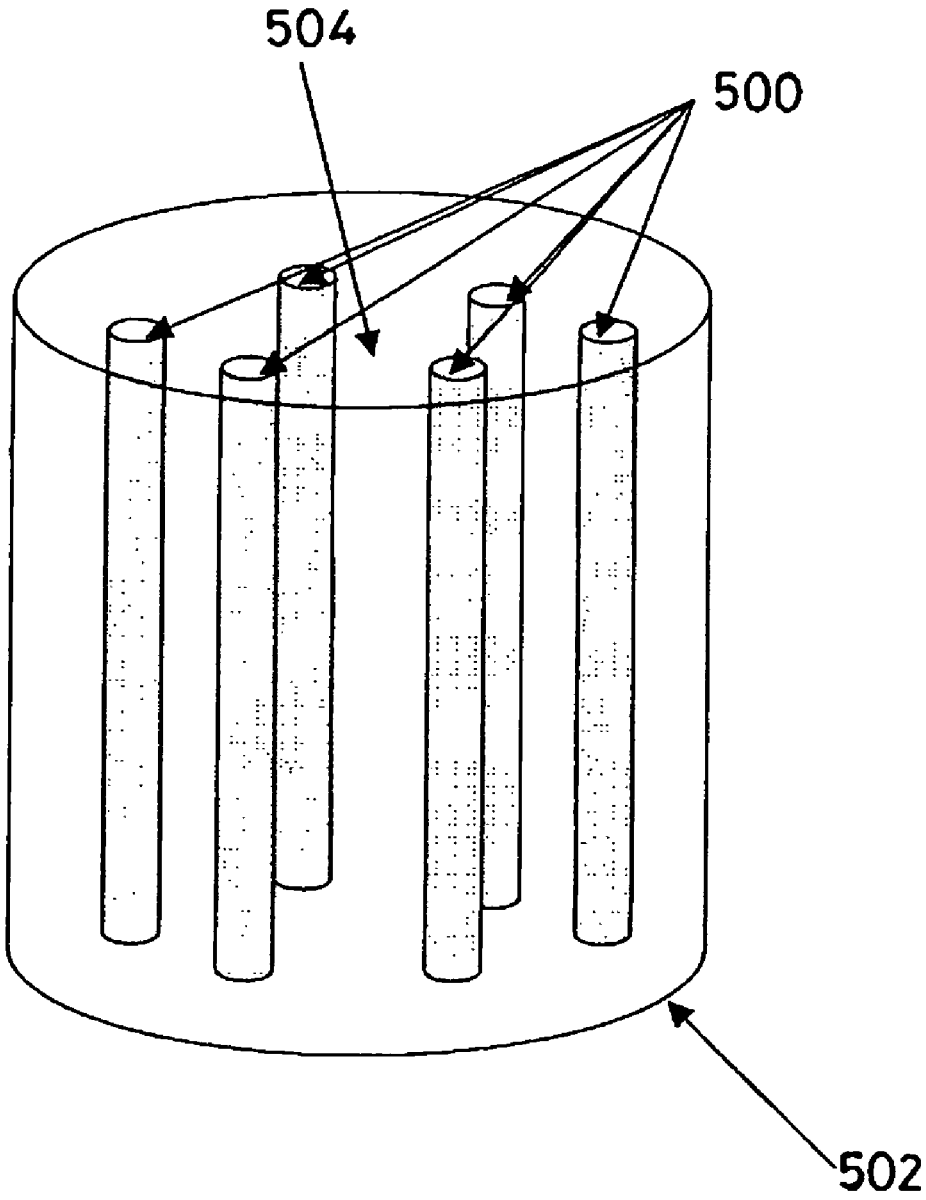
FIG. 15 is an electrode arrangement diagram showing an example of vacuum discharge (glow discharge).

FIG. 15 is an electrode arrangement diagram showing the example of vacuum discharge (glow discharge). The vacuum chamber composes the second electrode 502, and plural rod-shaped first electrodes 500 are disposed in said second electrode 502. Therefore, a large capacity of plasma 504 spread through the whole chamber is formed by glow discharge.

Figure 16:
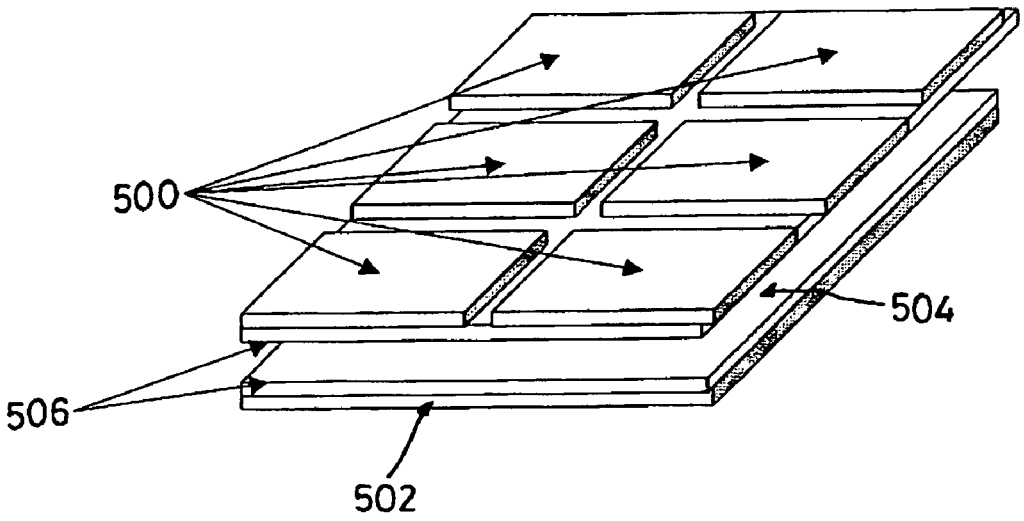
FIG. 16 is an electrode arrangement diagram showing an example of dielectric discharge (barrier discharge).
Figure 17:
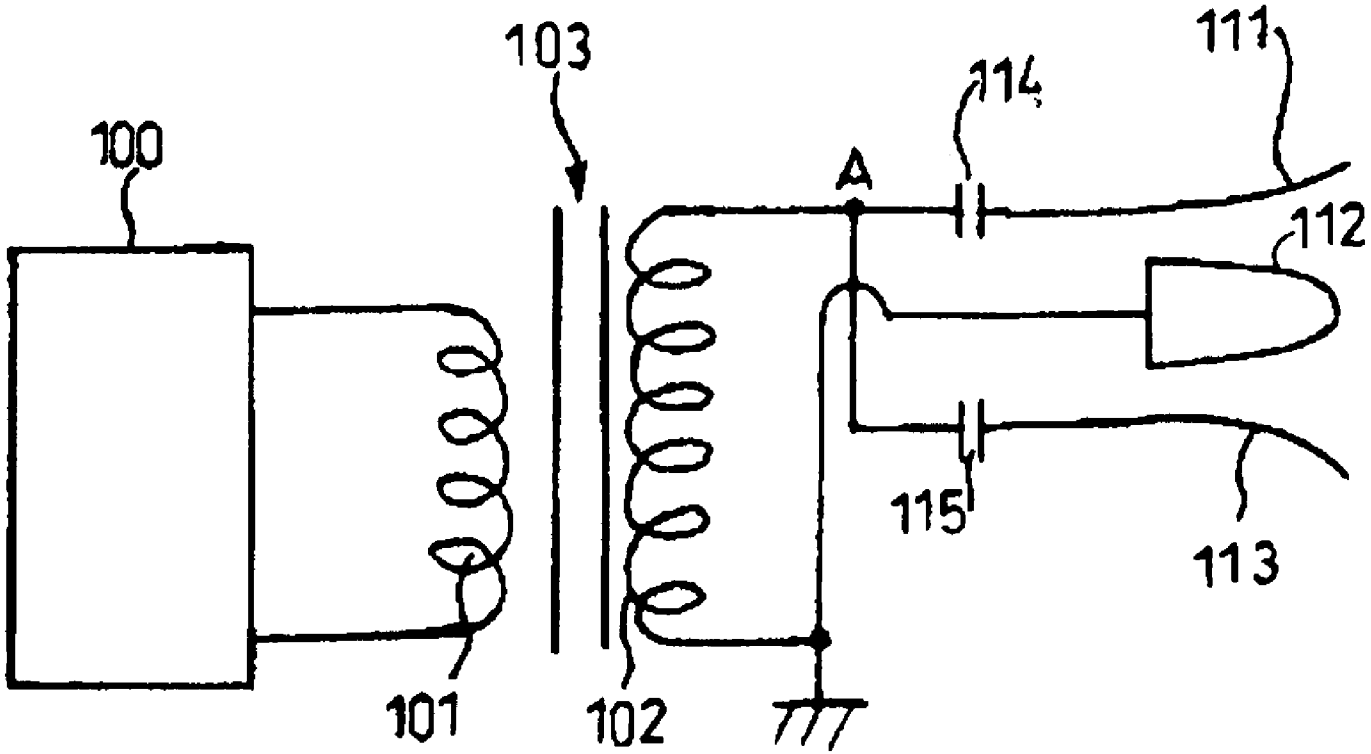
Fig. 17 PRIOR ART
FIG. 17 is an outlined schematic diagram of the plasma generating apparatus explaining the background art of the present invention.
Figure 18:
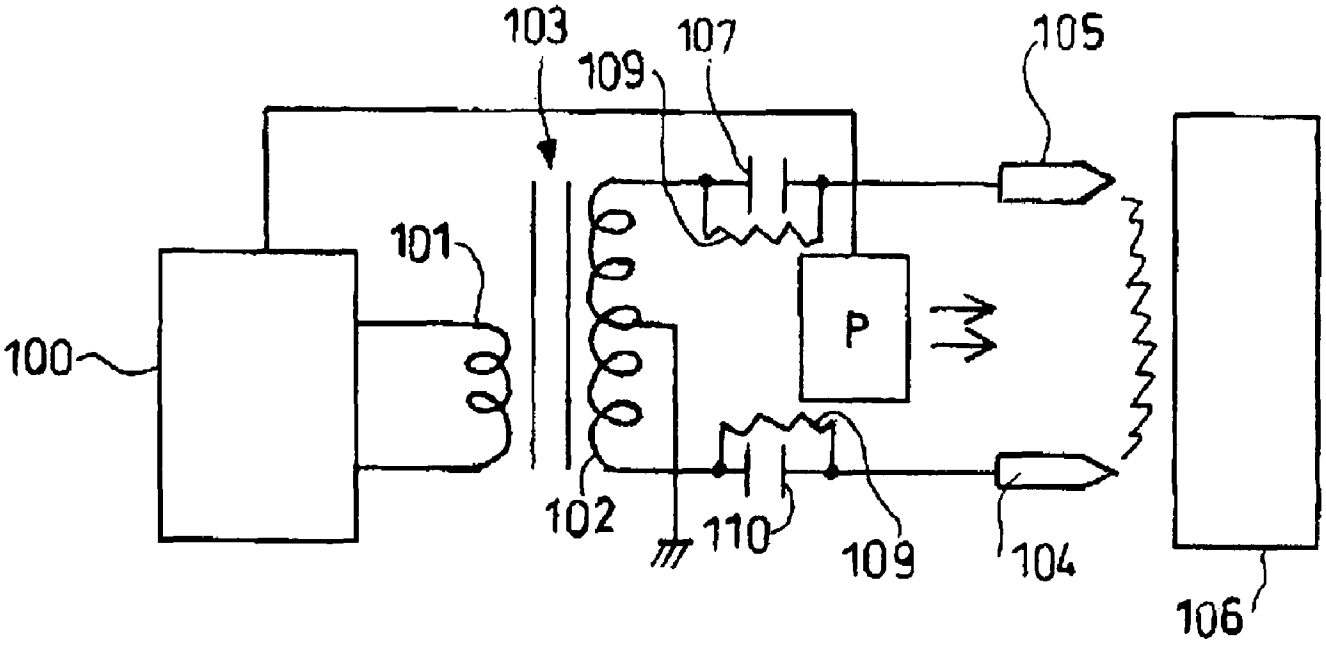
Fig. 18 PRIOR ART
FIG. 18 is an outlined schematic diagram of the plasma processing apparatus using a conventional plasma generating apparatus.

FIG. 16 is an electrode arrangement diagram showing the example of dielectric discharge (barrier discharge). Second electrode 502 of large area and many first electrodes 500 of small area opposed to said second electrode are disposed. Dielectric 506, 506 are arranged on facing sides of first electrode 500 and second electrode 502, and the barrier discharge occurs in a gap between said dielectrics. Therefore, the plasma 504 of large area is formed by said barrier discharge.

It is needless to say that the present invention is not limited to the above-described embodiments; and various modifications and design changes, etc. are included in the scope of the present invention within this limits which do not deviate from the technical spirit of the present invention.

INDUSTRIAL APPLICABILITY

When the first form and the fourth form of the present invention are used, the alternating high voltage generating circuit can be used in common against discharge generating electrodes comprising of two or more first electrodes and one or more second electrode, so that the power supply circuit for plasma generation and the plasma generating apparatus can be cheaply realized and a large quantity of plasma can be smoothly obtained without making jumboize an apparatus.

When the second form and the fifth form of the present invention are used, plural first electrodes can be discharged simultaneously at one secondary side coil by using of the high frequency transformer for alternating high voltage generating circuit, so that the power supply circuit for plasma generation and the plasma generating apparatus can be cheaply realized and a large quantity of generated plasma due to plural electrode pairs can be smoothly obtained without making jumboize an apparatus.

When the third form and the sixth form of the present invention are used, the discharge of n(integer) pairs is possible in said first and second forms, and the plasma of the number of n×m can be generated in the case of secondary side coil of the number of m(integer), so that miniaturization and cost reduction of the power supply unit can be realized.

When the seventh form of the present invention is used, the plural plasma output portions of nozzle shape can be arranged in said first and second forms, so that the composed plasma generating apparatus which can emit a large quantity of plasma can be realized without making jumboize apparatus by common use of said alternating high voltage generating circuit.

When the eighth form of the present invention is used, the plural output portions emitting plasma diffusively in a planar shape can be arranged, so that the composed plasma generating apparatus which can emit a large quantity of plasma can be realized without making jumboize apparatus by common use of said alternating high voltage generating circuit.

When the ninth form of the present invention is used, air flow, for example, can be generated by means of the fluid supplying means, and can be blown to the object to be processed by flowing to said plasma generation area, so that the generation plasma can be efficiently utilized.

When the tenth form of the present invention is used, the plural output portions emitting plasma in a linear shape can be arranged, so that the composed plasma generating apparatus which can irradiate plasma in a linear shape can be realized.

When the eleventh form of the present invention is used, the object to be processed can be irradiated by a large quantity of plasma emitted simultaneously from plural electrode pairs, so that the plasma processing gets possible efficiently depending on the shape and quantity of said object. In this process, there are contained a wide range of processes such as surface treatment, sterilization, disinfection, washing, reforming, wettability improvement, cutting and production of purpose substance from object to be processed.

When the twelfth form of the present invention is used, the object to be processed is introduced into the plasma processing region formed from generation plasma due to said each electrode pair, so that more generation plasma can be irradiated at a time, and the improvement of processing ability can be planned. For example, if plural electrode pairs are disposed radially and the plasma is irradiated in the central region, the plasma density of central region suddenly increases, so that the object powder can be efficiently produced when the raw material gas as object to be processed is introduced into said plasma. In addition, if the object to be processed with arbitrary shape is passed in said central region, the circumferential surface of object can be processed simultaneously by plasma, so that the surface treatment such as layering and reforming is carried out effectively.

When the 13th form of the present invention is used, it can be realized the plasma processing apparatus which can magnify three-dimensionally the plasma processing region formed from generation plasma due to said each electrode pair. This spiral form includes the case that the plasma emitted from each electrode pair deviates from the center point, so that the plasma stream circles in the plasma processing region in this case, and the object to be processed such as raw material gas can be treated uniformly. In addition, in said excentric state, if the plasma is emitted angularly upwardly, said plasma circling stream rises spirally, so that the large capacity of plasma processing region can be realized and a large quantity of processing for object to be processed is enabled.

When the 14th form of the present invention is used, it can be realized the plasma processing apparatus which can output a large quantity of plasma in a bundle form by means of aggregate. That is to say, if the electrode pair is composed in the cylindrical electrode shape, the plasma jet emitted from each electrode pair can become in a bundle and the large plasma jet stream can be emitted, so that the promotion of efficiency of plasma processing can be planned when the object to be processed is treated by said large area plasma jet stream. In the case of no cylindrical electrode, the large capacity plasma stream can be formed by electrode pairs of arrangement such as accumulation, radial arrangement and bundling of their plural arrangements, so that the efficient treatment of object to be processed can be realized by said large capacity plasma stream.

When the 15th form of the present invention is used, the processing efficiency for object to be processed can be adjusted freely by regulating the irradiating distance. When the object to be processed is raw material gas, the plasma irradiation efficiency for the raw material gas is adjusted, so that the production efficiency of object can be regulated ideally. In addition, when the object to be processed is solid material, the surface treatment of solid material can be adjusted, so that it becomes possible to increase the efficiency to layer.

When the 16th form of the present invention is used, the irradiation direction of plasma emitted by electrode pair for object to be processed is controlled and adjusted freely. For example, in the case that electrodes are disposed radially in the cylindrical reaction portion, by changing the irradiation direction of plasma freely, it can be adjusted in best way the reaction efficiency which produces the object powder for raw material gas supplied to said cylindrical reaction portion. In addition, when the object to be processed is solid material, the treatment condition of solid material surface can be changed, so that the optimum design can be realized depending on purposes of plasma processing.

When the 17th form of the present invention is used, for example, fuel gas, catalyst and powder etc. can be brought so as to contact with generated plasma through said passageway of object to be processed, so that the production efficiency of object can be adjusted. The passageway of object to be processed can distribute not only fluid such as gas and liquid but also solid material. Therefore, even if the object to be processed has any kind of form such as gas, liquid and solid, by means of designing the passageway of object to be processed appropriately, it gets possible to realize the plasma processing suitably.

When the 18th form of the present invention is used, the object to be processed can be transported through said passageway of object to be processed to a large quantity of plasma output in a bundle by said aggregate, so that improvement of processing efficiency can be planned through effective contact with said generated plasma. The plasma processing apparatus of said 11th to 18th form can be applied to the process such as shape transformation, pelletization, chamfering, surface roughening and projection removal of solid material like toner, glass, ceramics, metal, semiconductor, plastic, rubber and elastomer.

When the 19th form of the present invention is used, by utilizing the plasma processing material of any of said 7th to 14th forms, the predetermined plasma processed object can be produced through plasma processing of said object to be processed. By way of example only, through plasma-processing, it can be produced the object given the surface processing such as surface reforming, wettability improvement, cleaning, etching, resist stripping, painting, printing, print preprocessing, coating, evaporation, application, layer preprocessing, seal, sealing, joining, adhesion preprocessing, oxidization-resisting reinforcement, and reduction-resisting reinforcement. Moreover, it can be provided the object of solid with the surface membrane such as metal membrane, electroconductive • insulative • semiconductive ceramics membrane (oxide membrane, nitride membrane, carbide membrane etc: for example, aluminium oxide membrane, silicon oxide membrane, zinc oxide membrane, ITO (indium tin oxide membrane), ATO (antimony tin oxide membrane), dielectric membrane (barium titanate etc.), piezoelectric substance (PZT, AIN, ZnO etc.), magnetic substance membrane), superconductor membrane, diamondlike carbon membrane (called DLC, amorphous carbon membrane, or diamond-like carbon membrane), polymer • resin • plastic membrane, and fluoride membrane. In addition, it can be provided the object performed processing such as effluent gas processing of NOx or SOx, sterilization, pasteurization, washing, deodorization, waste oil disposal, polluted thing disposal of dioxin, and ozone disposal. Furthermore, it can be produced the carbon system nanoparticle synthesized by plasma processing as object such as carbon nanotube, carbon nanocoil, carbon nanotwist, carbon nanohorn, and fullerene, and can be also produced the functional particle as object such as titanium oxide, barium titanate, lithium manganate, lithium cobalt oxide, lithium nickel oxide, zinc oxide and silicon oxide.

The invention claimed is:

1. In a power supply circuit for plasma generation by which said plasma is generated due to discharge occurred between discharge generating electrodes composed of first and second electrodes by applying an alternating high voltage to said discharge generating electrodes, said power supply circuit for plasma generation comprising:

said discharge generating electrodes composed of two or more first electrodes and one or more second electrodes; and an alternating high voltage generating circuit to generate said alternating high voltage applied between said first and second electrodes of said discharge generating electrodes;

wherein a capacitor and an inductor are connected in series between said first electrode and one output end of said alternating high voltage generating circuit.

2. The power supply circuit for plasma generation according to claim 1, wherein said alternating high voltage generating circuit includes a high frequency transformer, two or more output circuits brunched in parallel from one end side of a secondary side coil of said high frequency transformer are connected to said first electrodes, each of said output circuits is formed by a series connection of said capacitor and said inductor, and said second electrode is connected to another end side of said secondary side coil.

3. The power supply circuit for plasma generation according to claim 1, wherein said alternating high voltage generating circuit includes a high frequency transformer, a plurality of secondary side coils are arranged at a secondary side of said high frequency transformer, one or more output circuits brunched in parallel from one end side of each secondary side coil are connected to said first electrodes, each of said output circuits is formed by a series connection of said capacitor and said inductor, and said second electrode is connected to another end side of said secondary side coil.

4. In a plasma generating apparatus by which said plasma is generated due to discharge occurred between discharge generating electrodes composed of first and second electrodes by applying an alternating high voltage to said discharge generating electrodes, said plasma generating apparatus comprising:

said discharge generating electrodes composed of two or more first electrodes and one or more second electrodes; and an alternating high voltage generating circuit to generate said alternating high voltage applied between said first and second electrodes of said discharge generating electrodes;

wherein a capacitor and an inductor are connected in series between said first electrode and one output end of said alternating high voltage generating circuit.

5. The plasma generating apparatus according to claim 4, wherein said alternating high voltage generating circuit includes a high frequency transformer, two or more output circuits brunched in parallel from one end side of a secondary side coil of said high frequency transformer are connected to said first electrodes, each of said output circuits is formed by a series connection of said capacitor and said inductor, and said second electrode is connected to another end side of said secondary side coil.

6. The plasma generating apparatus according to claim 4, wherein said alternating high voltage generating circuit includes a high frequency transformer, a plurality of secondary side coils are arranged at a secondary side of said high frequency transformer, one or more output circuits brunched in parallel from one end side of each secondary side coil are connected to said first electrodes, each of said output circuits is formed by a series connection of said capacitor and said inductor, and said second electrode is connected to another end side of said secondary side coil.

7. The plasma generating apparatus according to claim 4, 5 or 6, wherein either one electrode of said first electrode or said second electrode has a geometry surrounding the other electrode, and a tip end portion of said one electrode is formed into a nozzle shape for emitting said plasma generated between said electrodes.

8. The plasma generating apparatus according to claim 4, 5 or 6, wherein said first electrode and said second electrode are facing, so that said plasma generated between said electrodes is emitted from an open end side of said electrodes.

9. The plasma generating apparatus according to claim 4, 5 or 6, wherein said plasma generating apparatus further includes a fluid supplying means to supply a fluid into a generation area of said plasma generated between said electrodes.

10. The plasma generating apparatus according to claim 4, 5 or 6, wherein each of said electrode pairs is arranged in a predetermined direction.

11. A plasma processing apparatus characterized in that said plasma processing apparatus characterized in that said plasma processing apparatus includes the plasma generating apparatus according to any of claims 4, 5or 6 and an object to be processed is irradiated with said plasma generated between said electrodes.

12. The plasma processing apparatus according to claim 11, wherein each of said electrodes is arranged so that emitting directions of said plasma generated between said electrodes are facing each other.

13. The plasma processing apparatus according to claim 11, wherein each of said electrodes is arranged so that emitting positions of said plasma generated between said electrodes are formed in a spiral.

14. The plasma processing apparatus according to claim 11, wherein an aggregate of said electrodes is formed in a bundle by assembling emitting portions of said plasma generated between said electrodes.

15. The plasma processing apparatus according to claim 11, wherein said plasma processing apparatus further includes an adjusting means for adjusting an irradiating distance to said object to be processed irradiated with said plasma emitted from between said electrodes.

16. The plasma processing apparatus according to claim 11, wherein said plasma processing apparatus further includes an adjusting means for adjusting a direction irradiating said object to be processed with said plasma emitted from each space between said electrodes.

17. The plasma processing apparatus according to claim 11, wherein said plasma processing apparatus further includes a passageway of object to be processed distributing said object to be processed in vicinity of each of said electrodes.

18. The plasma processing apparatus according to claim 14, wherein said plasma processing apparatus further includes a passageway of object to be processed distributing said object to be processed to the center of said aggregate of said electrodes.

19. A plasma processed object characterized in that said plasma processed object is produced by use of the plasma processing apparatus according to claim 11, and said plasma processed object is produced by plasma processing of said object to be processed.

* * * * *